US007934939B2

(12) United States Patent
Chen et al.

(10) Patent No.: US 7,934,939 B2
(45) Date of Patent: May 3, 2011

(54) COMPLEX CONNECTOR

(75) Inventors: Haijun Chen, Makinohara (JP); Genfu Zeng, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/624,467

(22) Filed: Nov. 24, 2009

(65) Prior Publication Data

US 2010/0130039 A1 May 27, 2010

(30) Foreign Application Priority Data

Nov. 26, 2008 (JP) ..... 2008-301472

(51) Int. Cl.
*H01R 13/627* (2006.01)

(52) U.S. Cl. ..... 439/352; 439/924.1

(58) Field of Classification Search ..... 439/352–354, 439/357, 358, 488, 489, 701, 924.1, 924.2
See application file for complete search history.

(56) References Cited

U.S. PATENT DOCUMENTS 4,867,699 A * 9/1989 Oda et al. ..... 439/355
5,507,666 A * 4/1996 Yamanashi ..... 439/489
6,261,116 B1 * 7/2001 Ceru ..... 439/352
7,217,150 B2 * 5/2007 Lekic et al. ..... 439/352
7,399,195 B2 * 7/2008 Kim et al. ..... 439/352
7,438,570 B2 * 10/2008 Mori et al. ..... 439/157
7,544,074 B2 * 6/2009 Buck et al. ..... 439/144
2006/0110957 A1 5/2006 Lekic et al.

FOREIGN PATENT DOCUMENTS

JP 2006-156380 A 6/2006

* cited by examiner

*Primary Examiner* — Thanh-Tam T Le
(74) *Attorney, Agent, or Firm* — Sughrue Mion, PLLC

(57) ABSTRACT

A complex connector, comprises a male connector composed of a first male connector and the second male connector formed integrally with each other; a first female connector to which a second female connector and a lock assistant are attached in a movable manner, wherein the lock assistant includes an elongated cantilever member extending toward the first male connector, and a projection retaining engagement with the engagement portion of the first female connector is formed at a distal end of the elongated cantilever member, and in a condition in which the first male connector and the first female connector are disengaged from each other, the projection is retainingly engaged with the engagement portion, and in a condition in which the projection is retainingly engaged with the engagement portion, the projecting portion of the second female connector abuts against the abutment portion of the lock assistant.

9 Claims, 19 Drawing Sheets

(a)

(b)

(c)

(d)

(e)

(f)

(g)

(a)

(b)

(c)

(d)

(e)

(f)

COMPLEX CONNECTOR

BACKGROUND OF THE INVENTION

1. Field of the Invention

This invention relates to a complex connector including a plurality of pairs of male and female connectors, in which the function of giving an order of fitting and disengagement of the plurality of pairs of connectors is achieved with a mechanical construction.

2. Background Art (Conventional Connector)

Among conventional complex connectors including a first connector and a second connector, there is already known the type of connector in which after a first connector and a second connector are completely connected, the second connector is connected to the second connector (see, for example, Patent Literature 1).

Patent Literature 1: JP-A-2006-156380

(Construction of the Invention of Patent Literature 1)

A connector device of the invention of Patent Literature 1 comprises a first connector, a second connector, and holding means as described below.

The first connector comprises a housing including a first end portion, a second end portion, first receiving chambers for first contact elements, and first lock means. A slider forming a socket for second contact elements is movably mounted on this housing.

On the other hand, the second connector forms a socket for first corresponding contact elements which are connected respectively to the first contact elements when the first and second connectors are connected. The second connector further includes second lock means which is engaged with the first lock means when the first and second connectors are completely connected together. The second connector further contains second corresponding contact elements, and only when the first lock means of the housing of the first connector is completely connected to the second lock means of the second connector, the holding means allows the movement of the slider so that the second contact elements provided at the slider can contact the second corresponding contact elements, respectively.

(Operation of the Invention of Patent Literature 1)

When the first and second connectors continue to be connected, first, the first contact elements are brought into contact with the respective first corresponding contact elements, but the second contact elements are not yet brought into contact with the respective second corresponding contact elements. When the first and second connectors further continues to be connected, a retaining arm can be disposed in an initial position where it is loosened, and the retaining arm is moved by springs, so that the second contact elements are brought into contact with the respective second corresponding contact elements.

Even when the first contact elements are completely connected to the respective first corresponding contact elements, an electric current can not yet flow therebetween, and the second contact elements are connected to the second corresponding contact elements in a conducting condition simultaneously. As a result of this simultaneous connection, signal lines (wires) are connected together, and therefore the fact that the first contact elements and the first corresponding contact elements are mutually connected effectively is transmitted by a signal, and at this time an electric current of power supply flows between the first contact elements and the first corresponding contact elements.

(Drawbacks of the Invention of Patent Literature 1)

(Drawback 1)

Although the invention of Patent Literature 1 teaches a concept that the connection between the first contact elements and the first corresponding contact elements and the connection between the second contact elements and the second corresponding contact elements are effected with a time difference (time lag), the flowing of the electric current is effected simultaneously.

In other words, there is provided the structure in which a main circuit (K1) and an interlock circuit (signal circuit K2) are completely connected, but in the invention of Patent Literature 1, it was difficult to provide a time difference between the connection/breaking of the main circuit (K1) and the connection/interruption of the interlock circuit (signal circuit K2).

Therefore, in the case where a motor continues to rotate even when a control signal for the motor is interrupted, the generation of electricity is effected, and therefore in a circuit in which an inverter is connected to the motor, even when a male connector and a female connector of a main connector inserted in the inverter are disengaged (or disconnected) from each other, there is a possibility that electric power continues to be supplied from the rotating motor to the inverter in the case of the connector of Patent Literature 1, and therefore there was the risk of an electric shock.

(Drawback 2)

Furthermore, in the invention of Patent Literature 1, springs are required for connecting the second contact elements to the respective second corresponding contact elements, and therefore the cost of the springs was added, and besides an additional step of incorporating the springs in the connector was needed in the process of producing the connector, and further there was a fear of aged deterioration such as rust.

SUMMARY OF THE INVENTION

The present invention has been made in order to solve the above problems, and a first object of the invention is to provide a safe complex connector which eliminates the risk of an electric shock even when an inverter or others is connected to a motor.

It is a second object of the invention to provide a complex connector which does not need to incorporate separate parts such as springs therein, and therefore is low in cost and is excellent in productivity and durability.

A first aspect of the invention provides with a complex connector, comprising a first connector including a first male connector and a first female connector to be fitted to and disengaged from the first male connector; and a second connector, including a second male connector and a second female connector to be fitted to and disengaged from the second male connector; wherein the first male connector and the second male connector are formed integrally with each other; wherein the second female connector is mounted on the first female connector so as to move in a fitting/disengaging direction; wherein a lock assistant is mounted on the first female connector so as to move in the fitting/disengaging direction; and wherein the first male connector includes a retaining portion retaining engagement with the first female connector, and the first female connector includes a cantilever member extending toward the first male connector, and an engagement portion retaining engagement with the retaining portion of the first male connector is formed at a portion of disposed near to a distal end of the cantilever member, and in a condition in which the first male connector and the first female connector are fitted together, the retaining portion of the first male connector is retainingly engaged with the engagement portion; and the second female connector includes a projecting portion, and the lock assistant includes an abutment portion for abutting against the projecting portion, and when the projecting portion of the second female connector abuts against the abutment portion, the second female connector can not move any further on the first female connector in the fitting direction; and the lock assistant includes an elongated cantilever member extending toward the first male connector, and a projection for retaining engagement with the engagement portion of the first female connector is formed at a distal end of the elongated cantilever member, and in a condition in which the first male connector and the first female connector are disengaged from each other, the projection is retainingly engaged with the engagement portion, and in a condition in which the projection is retainingly engaged with the engagement portion, the projecting portion of the second female connector abuts against the abutment portion of the lock assistant.

With this construction, the second connector can be fitted after the first connector is fitted, and therefore an erroneous order of fitting can be prevented.

A second aspect of the invention provides with a complex connector, comprising a first connector including a first male connector and a first female connector to be fitted to and disengaged from the first male connector; and a second connector including a second male connector and a second female connector to be fitted to and disengaged from the second male connector; and wherein the first male connector and the second male connector are formed integrally with each other; and the second female connector is mounted on the first female connector so as to move in a fitting/disengaging direction; a lock assistant is mounted on the first female connector so as to move in the fitting/disengaging direction; and the first male connector includes a retaining portion for retaining engagement with the first female connector, and the first female connector includes a cantilever member extending toward the first male connector, and an engagement portion for retaining engagement with the retaining portion of the first male connector is formed at a portion disposed near to a distal end of the cantilever, and in a condition in which the first male connector and the first female connector are fitted together, the retaining portion of the first male connector is retainingly engaged with the engagement portion; and when an intermediate portion of the cantilever member of the first female connector is pressed inwardly from an outer side of the first female connector, the engagement portion is withdrawn from the retaining portion of the first male connector, so that the first male connector and the first female connector can be disengaged from each other; and the lock assistant includes an elongated cantilever member extending toward the first male connector, and a projection for retaining engagement with a distal end of the cantilever member of the first female connector is formed at a distal end of the elongated cantilever member, and in the condition in which the first male connector and the first female connector are fitted together, the projection is retainingly engaged with the distal end of the cantilever member; and the lock assistant includes a block member extending toward the first male connector, and when the projection is retainingly engaged with the distal end of the cantilever member in the fitted condition of the first male and female connectors, the block member covers an outer side of the intermediate portion of the cantilever member of the first female connector.

With this construction, the first connector can be disengaged after the second connector is disengaged, and therefore a time difference can be secured between the disengagement of the first connector and the disengagement of the second connector. Therefore, the second connector is disengaged to interrupt a control signal for a motor, thereby stopping the motor, and then the first connector of an inverter is disengaged with a time lag, that is, at the time when the rotation of the motor by inertia is stopped, and by doing so, the risk of an electric shock can be prevented.

A third aspect of the invention provides with a complex connector, comprising a first connector including a first male connector and a first female connector for being fitted to and disengaged from the first male connector; a second connector, including a second male connector and a second female connector for being fitted to and disengaged from the second male connector; and wherein the first male connector and the second male connector are formed integrally with each other; and wherein the second female connector is mounted on the first female connector so as to move in a fitting/disengaging direction; wherein a lock assistant is mounted on the first female connector so as to move in the fitting/disengaging direction; and wherein the first male connector includes a retaining portion retaining engagement with the first female connector, and the first female connector includes a cantilever member extending toward the first male connector, and an engagement portion retaining engagement with the retaining portion of the first male connector is formed at a portion of disposed near to a distal end of the cantilever member, and in a condition in which the first male connector and the first female connector are fitted together, the retaining portion of the first male connector is retainingly engaged with the engagement portion; and when an intermediate portion of the cantilever member of the first female connector is pressed inwardly from an outer side thereof, the engagement portion is withdrawn from the retaining portion of the first male connector, so that the first male connector and the first female connector can be disengaged from each other; and the second female connector includes a projecting portion, and the lock assistant includes an abutment portion for abutting against the projecting portion, and when the projecting portion of the second female connector abuts against the abutment portion, the second female connector can not move any further on the first female connector in the fitting direction; and the lock assistant includes an elongated cantilever member extending toward the first male connector, and a projection for retaining engagement with the engagement portion of the cantilever member of the first female connector and also for retaining engagement with a distal end of the cantilever member is formed at a distal end of the elongated cantilever member, and (a) in a condition in which the first male connector and the first female connector are disengaged from each other, the projection is retainingly engaged with the engagement portion, and in this condition the projecting portion of the second female connector abuts against the abutment portion of the lock assistant; and (b) the lock assistant includes a block member extending toward the first male connector, and when the projection is retainingly engaged with the distal end of the cantilever member in the fitted condition of the first male and female connectors, the block member covers an outer side of the intermediate portion of the cantilever member of the first female connector.

With this construction, the second connector can be fitted after the first connector is fitted, and also the first connector can be disengaged after the second connector is disengaged. Therefore, an erroneous order of fitting as well as an erroneous order of disengagement can be prevented, and an electric shock due to the inverter connected to the motor can be prevented.

A fourth aspect of the invention provides with the complex connector, wherein the lock assistant includes an annular body portion for surrounding an outer periphery of a housing of the first female connector, and the abutment portion formed at that portion of the annular body portion facing the second female connector; and the elongated cantilever member and the block member are formed at that portion of the annular body portion corresponding to the cantilever member of the first female connector, and are so arranged that the cantilever member is disposed between the elongated cantilever member and the block member such that the elongated cantilever member is disposed at an inner side of the cantilever member while the block member is disposed at an outer side of the cantilever member.

With this construction, the lock assistance which can be made by the use of a smaller amount of a material can effectively perform the function of preventing the movement of the second female connector prior to the fitting of the first connector (that is, the function of preventing a preferential fitting of the second connector), and also can effectively perform the function of preventing a preferential disengagement of the first connector prior to disengagement of the second connector.

A fifth aspect of the invention provides with the complex connector, wherein engagement members for engagement with each other are provided respectively at the second male connector and the second female connector, and in a condition in which the second male connector and the second female connector are fitted together, the engagement members are engaged with each other, and the fitted condition of the second male and female connectors can not be canceled unless the engagement of the engagement members with each other is canceled.

With this construction, an unintentional disengagement of the second male connector and the second female connector (which can be easily disengaged from each other upon application of a pulling force to signal wires) from each other can be easily and positively prevented.

A sixth aspect of the invention provides with the complex connector, wherein one of the engagement members has a tapering surface, and at the time when the second male connector and the second female connector are fitted together, the engagement members are automatically engaged with each other.

With this construction, the engagement members are automatically engaged with each other merely by fitting the second male connector and the second female connector together, and therefore an cumbersome operation for engaging the engagement members with each other in the fitting operation can be eliminated.

A seventh aspect of the invention provides with the complex connector the arrangement of the first connector and the second connector can be changed in a reverse manner, and also the arrangement of the male and female connectors of each of the first and second connectors can be changed in a reverse manner.

With this construction, the male connector (or the female connector) of the connector can be disposed at either side of the complex connector, and therefore the degree of freedom of design can be enhanced.

As described above, in the first aspect of the invention, the second connector can be fitted after the first connector is fitted, and therefore the erroneous order of the fitting can be prevented. In the second aspect of the invention, the first male connector and the first female connector can be disengaged from each other after the second male connector and the second female connector are disengaged from each other, and therefore the order of disengagement of the first connector and the second connector can be defined, and the erroneous order of the disengagement can be prevented. Therefore, an electric shock due to a battery or an inverter connected to the motor can be prevented.

In the third aspect of the invention, the second male connector and the second female connector can be fitted together after the first male connector and the first female connector are fitted together. Also, the first male connector and the first female connector can be disengaged from each other after the second male connector and the second female connector are disengaged from each other. Therefore, the order of fitting/disengagement of the first and second connectors can be defined, and the erroneous order of the fitting as well as the erroneous order of the disengagement can be prevented. Therefore, an electric shock due to the battery or the inverter connected to the motor can be prevented.

In the fourth aspect of the invention, the lock assistance which can be made by the use of a smaller amount of a material can effectively perform the function of preventing the movement of the second female connector prior to the fitting of the first connector (that is, the function of preventing the preferential fitting of the second connector), and also can effectively perform the function of preventing the preferential disengagement of the first connector prior to disengagement of the second connector.

In the fifth aspect of the invention, an unintentional disengagement of the second male connector and the second female connector (which can be easily disengaged from each other upon application of a pulling force to the signal wires) from each other can be easily and positively prevented.

In the sixth aspect of the invention, the engagement members are automatically engaged with each other merely by fitting the second male connector and the second female connector together, and therefore the cumbersome operation for engaging the engagement members with each other in the fitting operation can be eliminated.

In the seventh aspect of the invention, the male connector (or the female connector) of the connector can be disposed at either side of the complex connector, and therefore the degree of freedom of design can be enhanced.

Thus, in the present invention, the opening/closing of the interlock circuit K2 (the signal circuit) and the opening/closing of the main circuit K1 (the second circuit) are effected with a time difference, utilizing the locking/canceling operation of the lock assistant, and therefore the connectors connected between equipments can be positively connected and disconnected, and the risk of an electric shock can be eliminated.

With respect to the order of fitting of the connectors, first, the main circuit K1 is fitted (closed), and then the interlock circuit K2 (the signal circuit) is fitted (closed). With respect to the order of disengagement of the connectors, first, the interlock connector circuit K2 (the signal circuit) is disengaged (opened), and then the main circuit K1 (the second circuit) is disengaged (opened), and therefore the possibility of effecting the operation in a reverse order can be mechanically prevented.

Furthermore, any spring member is not used, and therefore the connector free from disadvantages (high cost, an additonal step of the production process and aged deterioration) can be obtained.

DESCRIPTION OF THE PREFERRED EMBODIMENTS

A preferred embodiment of the present invention will now be described with reference to the drawings.

(Five Elements Forming Complex Connector of the Present Invention)

Figure 1:
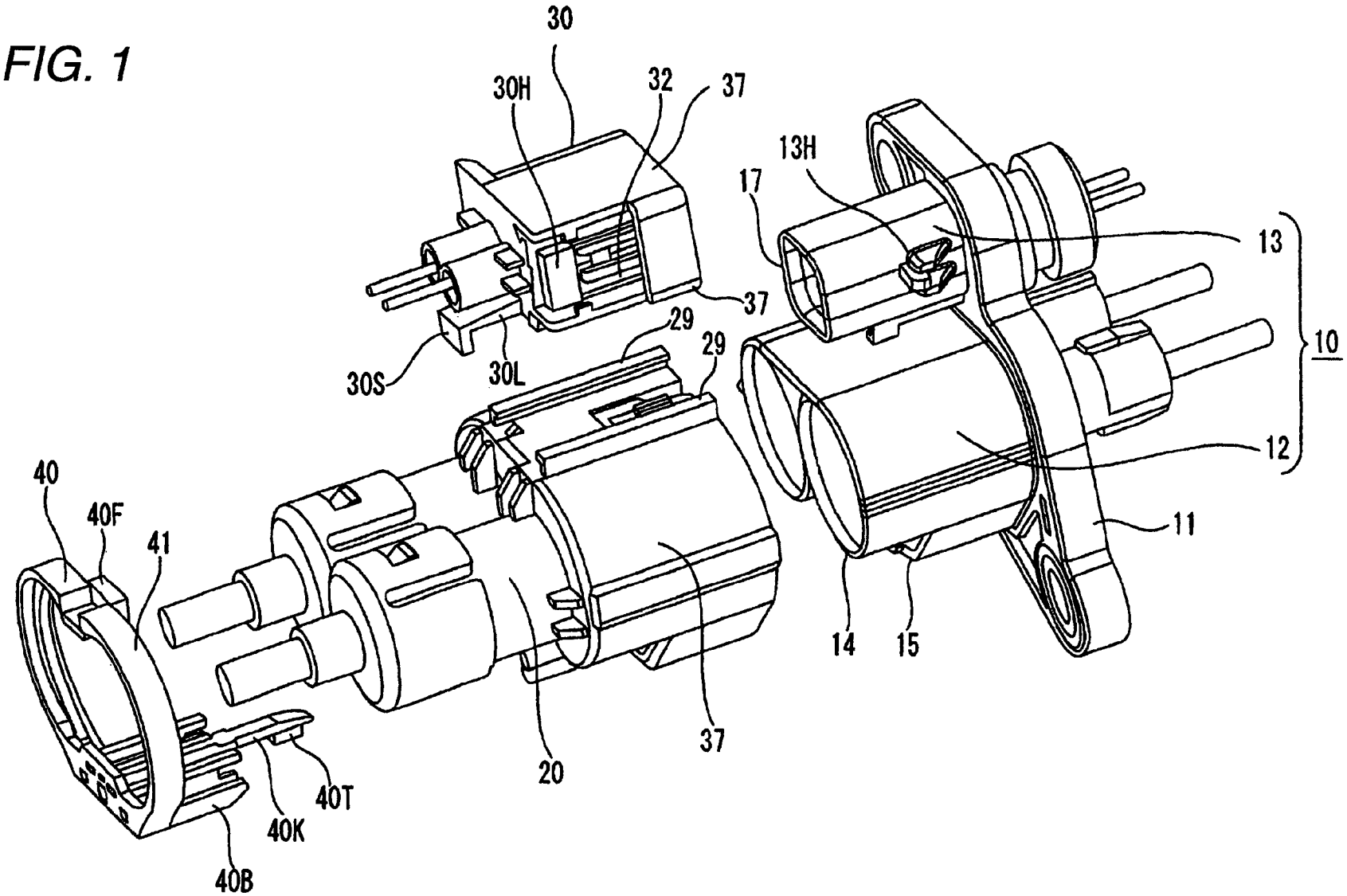
FIG. 1 is an exploded perspective view showing a complex connector of the present invention.
Figure 2:
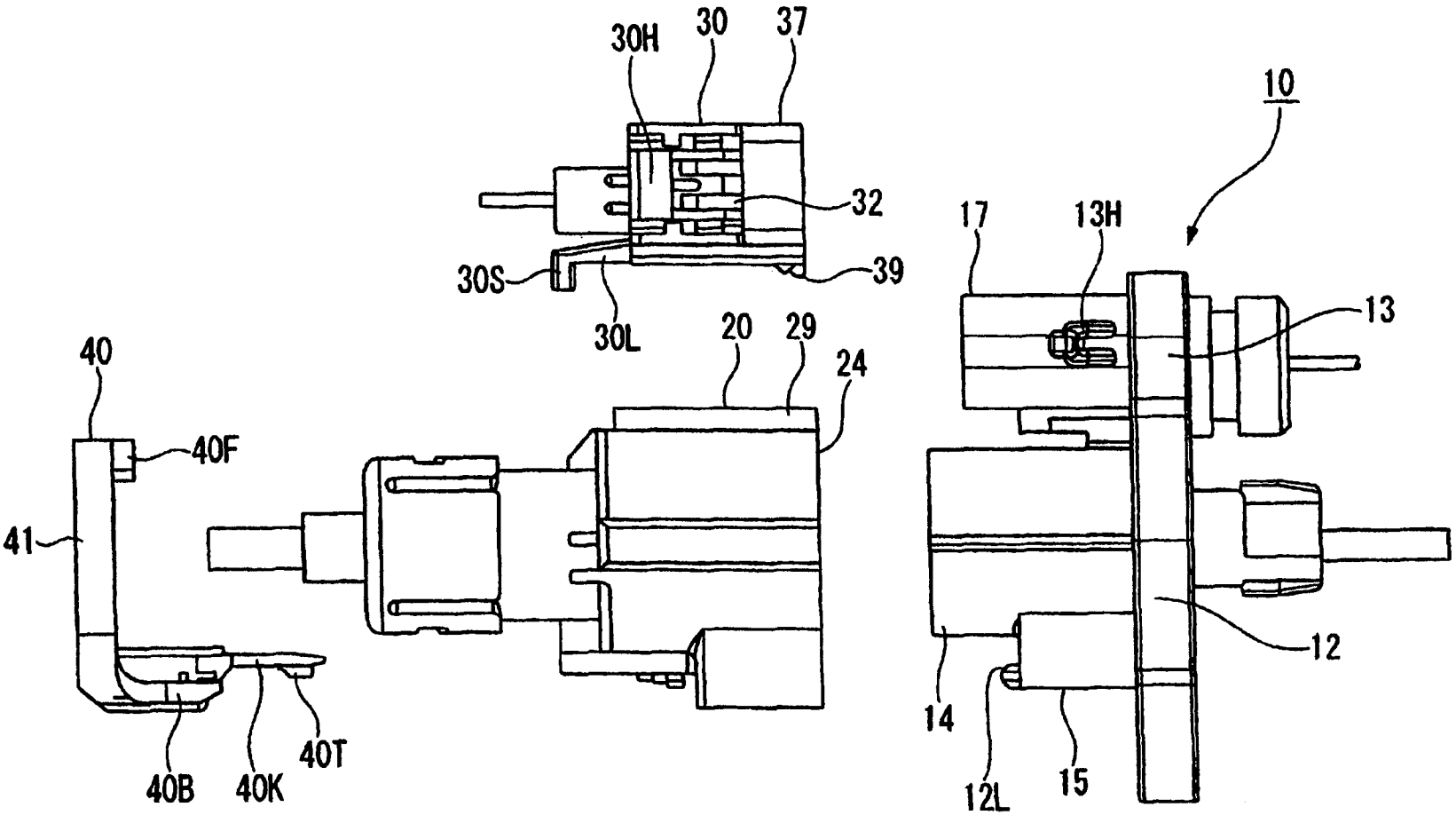
FIG. 2 is a front-elevational view of the complex connector of FIG. 1.
Figure 3:
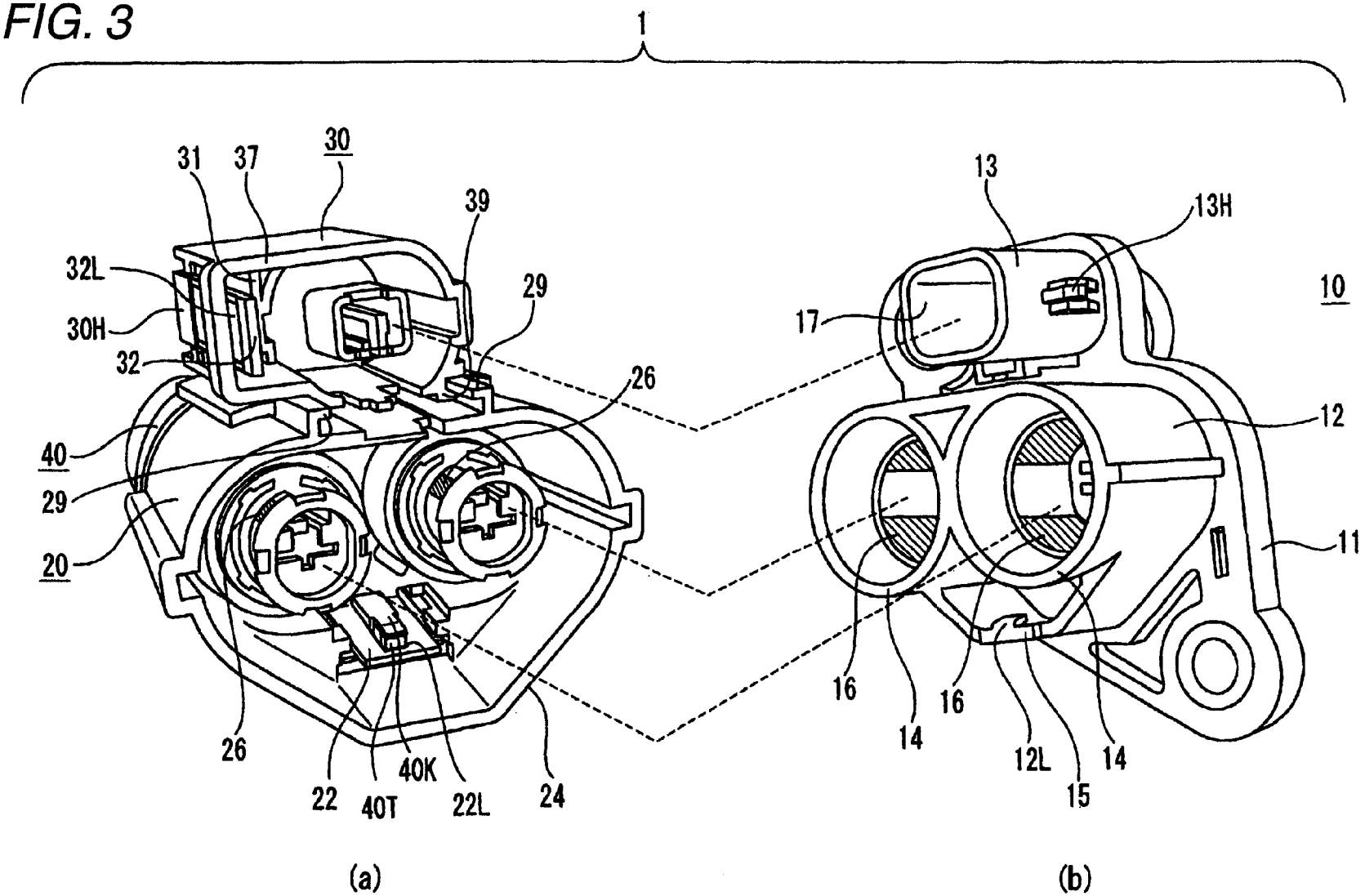
FIG. 3 is perspective views showing the complex connector of the invention in its disengaged condition, and (a) in FIG. 3 shows a main female connector-side while (b) in FIG. 3 shows a main male connector-side.

FIG. 1 is an exploded perspective view showing a complex connector of the invention, FIG. 2 is a front-elevational view of the complex connector of FIG. 1, and FIG. 3 are perspective views showing the complex connector in its disengaged (or disconnected) condition, and (a) in FIG. 3 shows a main female connector-side while (b) in FIG. 3 shows a main male connector-side.

In FIGS. 1 to 3, the complex connector 1 of the invention comprises a male connector 10 including a main male connector 12 and an interlock male connector 13 which are formed (or molded) integrally on a common flange 11, a main female connector 20 for being fitted to and disengaged from the main male connector 12, an interlock female connector 30 mounted on the main female connector 20 for movement in a fitting/disengaging direction so as to be fitted to and disengaged from the interlock male connector 13, and a lock assistant 40 mounted on the main female connector 20 for movement in the fitting/disengaging direction.

The constructions of (1) the main male connector 12, (2) the main female connector 20, (3) the interlock male connector 13, (4) the interlock female connector 30 and (5) the lock assistant 40 will be described below in this order.

(Construction of Main Male Connector 12)

The main male connector 12 is used mainly as a connector for a power line, and is larger in size than the interlock male connector 13. Terminals 16 (FIG. 3) for wires are received respectively in two cylindrical housings 14 (FIG. 3). A connection portion of the main male connector 12 may have a known general-purpose construction.

{Feature 1}

In the present invention, a lock claw 12L (FIG. 2 and (b) in FIG. 3) is formed on an inner surface of a housing 15 formed on and extending from an outer surface of the cylindrical housings 14. When the main male connector 12 is fitted to the main female connector 20, this lock claw 12L is retained in a retaining hole 22L (FIG. 3) of the main female connector 20 to lock the main male and female connectors 12 and 20 to each other against disengagement from each other.

(Construction of Main Female Connector 20)

The main female connector 20 is also used as a connector for the power line, and is larger in size than the interlock female connector 30. Terminals 26 (FIG. 3) for wires are received in a common housing 24 (FIG. 3). A connection portion of the main female connector 20 may have a known general-purpose construction.

A pair of parallel long rails 29 (FIG. 1 and FIG. 3 of an inverted L-shaped cross-section for holding the interlock female connector 30 in a manner to allow the movement of this connector 30 along these rails 29 are formed on an upper surface of the common housing 24.

{Feature 1}

Figure 14:
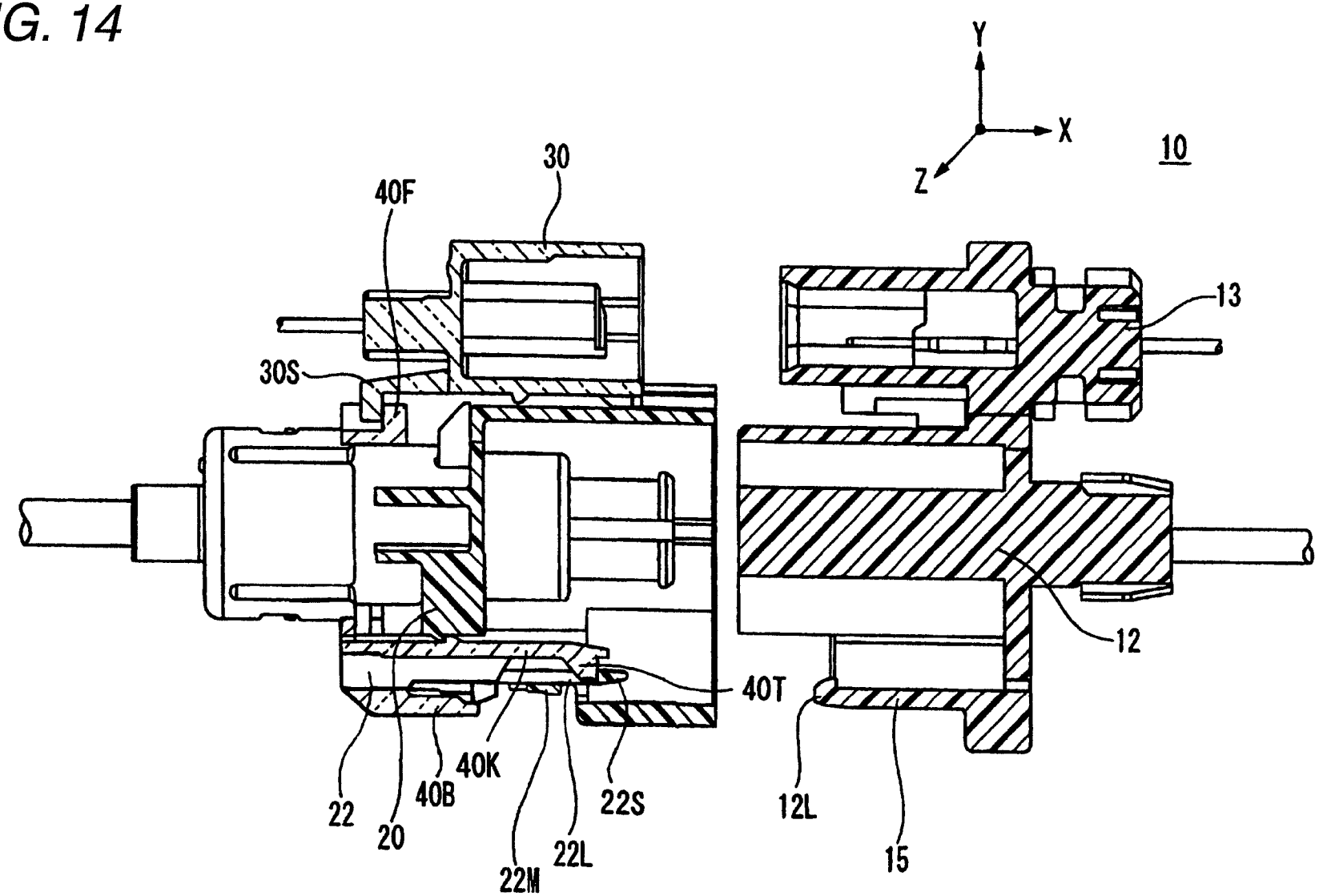
FIG. 14 is a vertical cross-sectional view through an axis, showing a condition in which the main female connector and the main male connector are disengaged from each other.

In the present invention, a cantilever arm 22 (see (a) in FIG. 3 and FIG. 14) is formed within the common housing 24 and is disposed at a lower portion thereof, and has its free (or distal) end directed in the fitting direction. The retaining hole 22L ((a) in FIG. 3 and FIG. 14) is formed through that portion of the cantilever arm 22 disposed near to the distal end thereof.

When the main female connector 20 is fitted to the main male connector 12, this retaining hole 22L is retainingly engaged with the lock claw 12L (FIG. 3) of the main male connector 12 to lock the main female and male connectors 20 and 12 to each other against disengagement from each other.

Next, a locking operation of the lock claw 12L and retaining hole 22L will be described.

(Locking Operation of Lock Claw 12L and Retaining Hole 22L)

The cantilever arm 22 (FIG. 4) has a long flat plate-like shape, and is reduced in thickness at its free (or distal) end portion 22S.

On the other hand, the lock claw 12L (FIG. 3 and FIG. 14) is in the form of an upwardly-directed projection, and has such a slanting surface that it is decreasing in height gradually in the fitting direction.

In the fitting operation, the main female connector 20 is moved toward the main male connector 12, and when the lock claw 12L is brought into abutting engagement with the distal end 22S of the cantilever arm 22, the distal end 22S of the cantilever arm 22 abuts against the slanting surface of the lock claw 12L (see FIG. 15), and when the main female connector 20 is further moved, the distal end 22S of the cantilever arm 22 advances obliquely upwardly along this slanting surface, and when the main female connector 20 is further moved, the distal end 22S of the cantilever arm 22 slides over the lock claw 12L, and finally the lock claw 12L becomes fitted in the retaining hole 12L formed in the portion of the cantilever arm 22 disposed near to the distal end 22S, thus completing the locking operation (see FIG. 16), and thereafter the main female and male connectors 20 and 12 can not be disengaged from each other (For disengaging the two connectors from each other, the following lock cancellation operation is required). In this condition, the fitting of the main male and female connectors 12 and 20 to each other is completed.

(Cancellation of Locking of Lock Claw 12L and Retaining Hole 22L)

For canceling the locked condition (FIG. 16) in which the lock claw 12L is fitted in the retaining hole 22L formed through the portion of the cantilever arm 22 disposed near to the distal end 22S, the finger is held against an intermediate portion 22M (FIG. 16) of the cantilever arm 22, and the main female connector 20 is pulled in a direction away from the main male connector 12 while pressing the intermediate portion 22M in a direction to withdraw the lock claw 12L from the retaining hole 22L.

The intermediate portion 22M of the cantilever arm 22 is covered by a block member 40B (FIG. 1, FIG. 2 and FIG. 17) as described later so that the intermediate portion 22M can be easily pressed.

Further, a projection 40T (FIGS. 1 and 2) formed at a distal end of an elongated cantilever member 40K of the lock assistant 40 is retainingly engaged with the distal end of the cantilever lock arm 22 so that the block member 40B can not be easily moved. A slanting surface is formed at the rear side of the projection 40T, and when the main female connector is pulled hard, this locking engagement can be canceled.

(Construction of Interlock Male Connector 13)

Referring back to FIGS. 1 to 3, the construction of the interlock male connector 13 (which is the third element of the complex connector of the invention) will be described.

The interlock male connector 13 is used mainly as a connector for a signal line, and is smaller in size than the main male connector 12. Terminals for signal wires are received in a common housing 17. A connection portion of this male connector 13 may have a known general-purpose construction.

{Feature 1}

Figure 4:
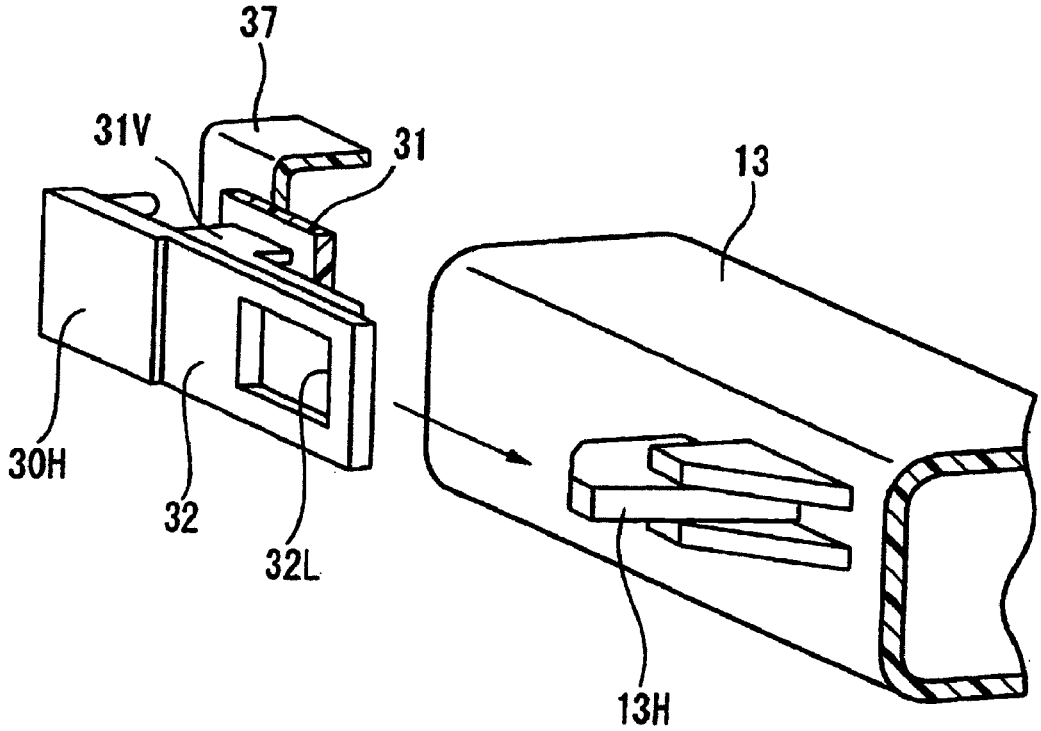
FIGS. 4 (*a*), (*b*) are perspective view explanatory of retaining portions of an interlock male connector and an interlock female connector, and FIG. 4(*a*) shows a condition before a retained condition is achieved, and FIG. 4(*b*) shows the retained condition.
Figure 4:
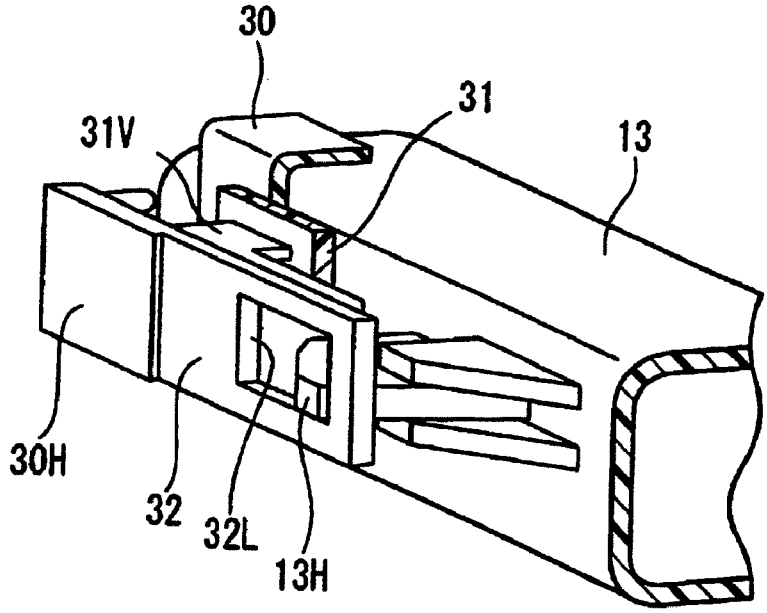

In the present invention, a lock claw 13H (see also FIG. 4(*a*), (*b*)) is formed on an outer surface of the interlock male connector 13, and is in the form of a projection, and has such a slanting surface that the amount of projecting of the lock claw 13H from the outer surface of the interlock male connector 13 is decreasing gradually in the fitting direction. When the interlock male connector 13 is fitted to the interlock female connector 30, this lock claw 13H is retained in a retaining hole 32L in the interlock female connector 30 to lock the two connectors 13 and 30 to each other against disengagement from each other.

(Construction of Interlock Female Connector 30)

The interlock female connector 30 (FIGS. 1 to 3) (which is the fourth element of the complex connector of the invention) is also used as a connector for the signal line, and is smaller in size than the main female connector 20. Terminals for signal wires are received in a common housing 37. A connection portion of this interlock female connector 30 may have a known general-purpose construction.

In the present invention, two engagement portions 39 for engagement respectively with the two long rails 29 of an inverted L-shaped cross-section formed on the upper surface of the main female connector 20 are formed on a lower surface of the common housing 37. The two engagement portions 39 are engaged respectively with the two rails 29.

{Feature 1}

In the present invention, a cantilever arm 30L (FIGS. 1 and 2) is formed at a lower portion of a rear end (facing in the disengaging direction) of the common housing 37, and has its free end portion directed in the disengaging direction. This free (or distal) end portion is formed into a stopper 30S of a downwardly-directed L-shape.

{Feature 2}

Further, a vertically-extending wall portion 31 (FIGS. 3 and 4(*a*), (*b*)) is formed within the common housing 37 and is disposed at a corner portion thereof.

In the present invention, the wall portion 31 serves as one of two clips of a clothespin-like member, and a laterally-extending portion 31V (FIG. 4(*a*), (*b*)) is formed on and extends perpendicularly from the wall portion 31. A portion 32 (hereinafter referred to as "clip 32") corresponding to the other clip of the clothespin-like member is formed at a distal end of the laterally-extending portion 31V. A retaining hole 32L (FIG. 4(*a*), (*b*)) is formed through that portion of the clip 32 disposed near to a distal end thereof, and an opposite end portion of the clip 32 serves as a handle portion 30H.

The wall portion 31, the laterally-extending portion 31V and the clip 32 are formed or molded integrally with each other, using a synthetic resin, and therefore the laterally-extending portion 31V and the clip 32 can be elastically deformed relative to the fixed wall portion 31, and can be slightly moved, and can be restored into their respective initial conditions.

Next, a locking operation of the retaining hole 32L (formed through the elastic clip 32) and lock claw 13H will be described.

(Locking Operation of Lock Claw 13H and Retaining Hole 32L)

Before the fitting operation, the interlock female connector 30 and the interlock male connector 13 are opposed to each other in spaced relation as shown in FIG. 4(*a*).

In this condition, when the interlock female connector 30 is moved toward the interlock male connector 13, the distal end of the clip 32 is brought into abutting engagement with the slanting surface 13K of the lock claw 13H, and the distal end of the clip 32, while gradually moved away from the axes of the connectors 30 and 13 because of the elasticity of the clip 32, moves along this slanting surface. When the interlock female connector 30 further moves toward the interlock male connector 13, the distal end of the clip 32 slides over the lock claw 13H, and finally the lock claw 13H becomes fitted in the retaining hole 32L formed through the portion of the clip 32 disposed near to the distal end thereof, thus completing the locking operation (see FIG. 4(*b*)).

For canceling this locked condition, the following operation is required.

(Cancellation of Locking of Lock Claw 13H and Retaining Hole 32L)

For canceling the locked condition in which the lock claw 13H is fitted in the retaining hole 32L formed through the portion of the clip 32 disposed near to the distal end thereof, the finger is held against the handle portion 30H (FIGS. 1 to 4(*a*), (*b*)) of the clip 32, and the handle portion 30H is pressed in a direction to withdraw the lock claw 13H from the retaining hole 32L. As a result, the portion of the clip 32 having the retaining hole 32L is moved or turned away from the lock claw 13H with the laterally-extending portion 31V serving as a fulcrum, and therefore the lock claw 13H is disengaged from the retaining hole 32L, and in this condition the interlock female connector 30 is moved apart from the interlock male connector 13 in the disengaging direction.

(Construction of Lock Assistant 40)

Referring back to FIGS. 1 to 3, the lock assistant 40 (which is the fifth element of the complex connector of the invention) will be described.

Although the above four elements are already known, the idea of this lock assistant 40 has been originated by the present invention. The lock assistant 40 is movably mounted on an outer peripheral portion of the common housing 37 of the main female connector 20. The lock assistant 40 is made or molded of a material which can be more easily elastically deformed than the material of which the above four elements are molded.

The lock assistant 40 includes an annular portion 41 for being mounted on the outer peripheral portion of the common housing 37, a lock member 40F formed at an upper portion of the annular portion 41, the block member 40B of a relative large width formed at a lower portion of the annular portion 41 and extending from the annular portion 41 in the fitting direction, and the elongated cantilever member 40K formed at the lower portion of the annular portion 41 and extending from the annular portion 41 in the fitting direction in overlying relation to a central portion of the block member 40B such that the cantilever member 40K is spaced a predetermined distance from the central portion of the block member 40B, the cantilever member 40 having the projection 40T formed at the lower surface of its distal end.

Next, the operations of (1) the lock member 40F, (2) the block member 40B and (3) the elongated cantilever member 40K will be described.

(Operation of Lock Member 40F)

The lock member 40F is disposed so as to face the L-shaped stopper 30S formed at the lower portion of the rear end of the common housing 37 (see also FIG. 14). The lock member 40F performs two (first and second) functions.

{First Function}

The first function is to prevent a preferential fitting of the interlock connector (13 and 30) in the fitting operation of the complex connector.

The interlock female connector 30 is moved in the fitting direction so as to be fitted to the interlock male connector 13, and at this time even if trying to move the interlock female connector 30 in the fitting direction further beyond an axial position where the main male connector 12 and the main female connector 20 are fitted together, the movement of the L-shaped stopper 30S of the interlock female connector 30 is prevented by the lock portion 40F, and therefore the interlock female connector 30 can not move any further.

Therefore, this first function prevents the occurrence of a situation in which in a condition in which the main male connector 12 and the main female connector 20 are not yet fitted together, only the interlock female connector 30 is further moved toward the interlock male connector 13 to be fitted thereto prior to the fitting of the main male and female connectors 12 and 20.

{Second Function}

The second function is to prevent a preferential disengagement of the main connector (12 and 20) in the disengaging operation of the complex connector.

Even if trying to disengage the main female connector 20 from the main male connector 12 prior to disengagement of the interlock connector when both the main connector and the interlock connector are in their respective fitted conditions (FIG. 17), the L-shaped stopper 30S of the interlock female connector 30 fitted to the interlock male connector 13 can not be moved, and the lock member 40F fills in a clearance between the L-shaped stopper 30S and the main female connector 20, and therefore the main female connector 20 can not be moved.

Therefore, this second function prevents the main female connector 20 from being disengaged from the main male connector 12 prior to disengagement of the interlock male connector 13 and the interlock female connector 30 from each other.

(Operation of Block Member 40B)

The lock assistant 40 is movable on the housing 37 of the main female connector 20, and therefore when the lock assistant 40 is moved, the block member 40B integral with this lock assistant 40 is also moved under the housing 37 of the main male connector 20.

Figure 5:
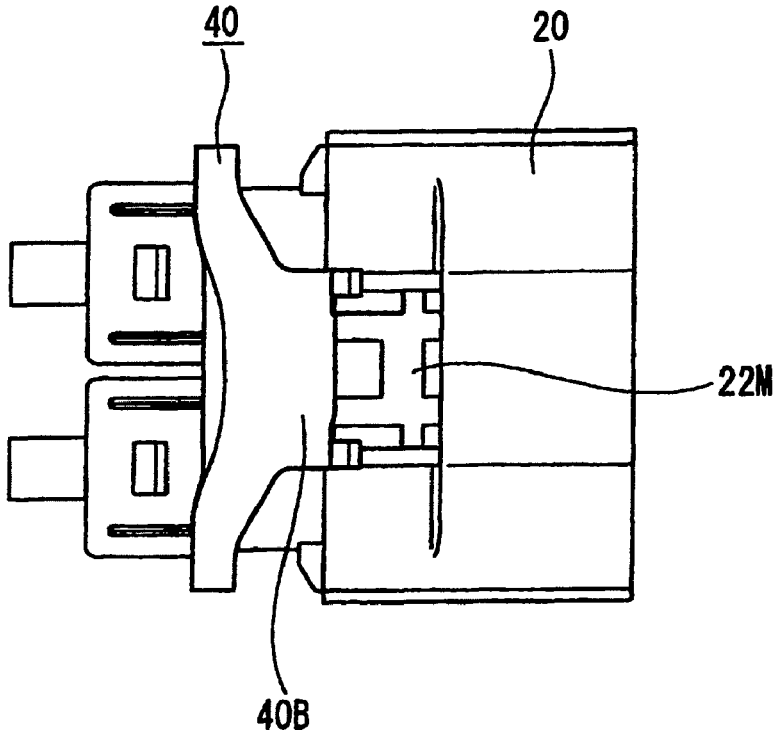
FIGS. 5 (*a*), (*b*) are bottom views of the main female connector, showing a block member for preventing cancellation of a retained condition of the main male connector and main female connector, and FIG. 5(*a*) shows a retracted condition of the block member, and FIG. 5(*b*) shows an operative condition of the block member.
Figure 5:
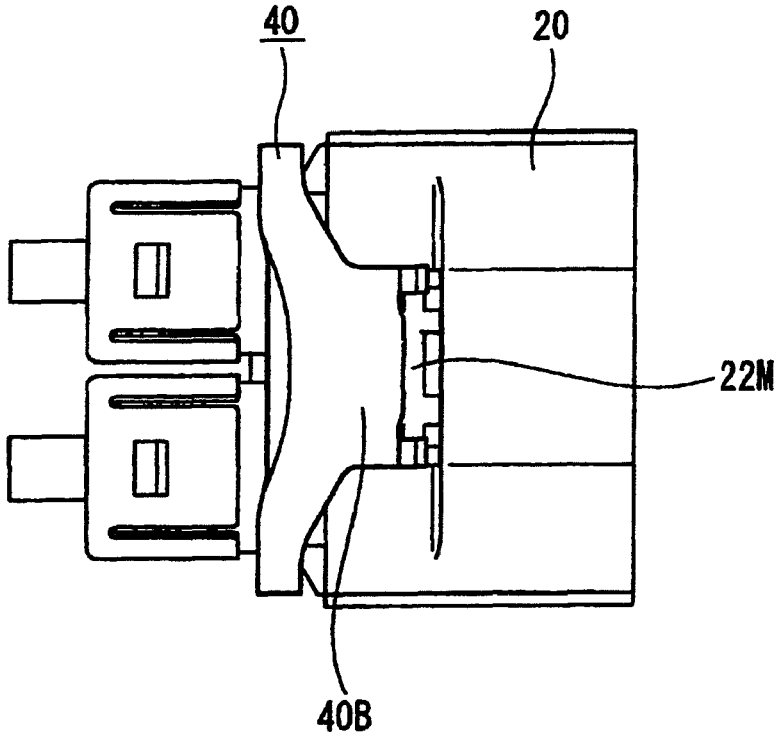

FIGS. 5(*a*) and 5(*b*) are bottom views of the main female connector which are explanatory of the block member, and FIG. 5(*a*) shows a retracted condition of the block member, and FIG. 5(*b*) shows an operative condition of the block member.

When the block member 40 is located in a rearmost position in the disengaging direction, this condition is shown in FIG. 5(*a*). Namely, the block member 40B is retracted from the region where the intermediate portion 22M of the cantilever arm 22 exists (see also FIG. 16). Therefore, when the operator presses the intermediate portion 22M with the finger (in a direction toward the reverse side of the sheet of FIG. 5(*a*)), the cantilever arm 22 is lifted, and the lock claw 12L is disengaged from the retaining hole 22L (FIG. 3) in the cantilever arm 22, so that the main male connector 12 and the main female connector 20 can be disengaged from each other.

On the other hand, when the lock assistant 40 is moved in the fitting direction, the block member 40 integral with the lock assistant 40 is also moved, and this condition is shown in FIG. 5(*b*). Namely, the block member 40B is moved to the region where the intermediate portion 22M exists (see FIGS. 17 and 18), and therefore the operator can not press the intermediate portion 22M because of the block member 40. Therefore, the main male connector 12 and the main female connector 20 can be disengaged from each other.

(Function of Elongated Cantilever Member 40K)

Figure 6:
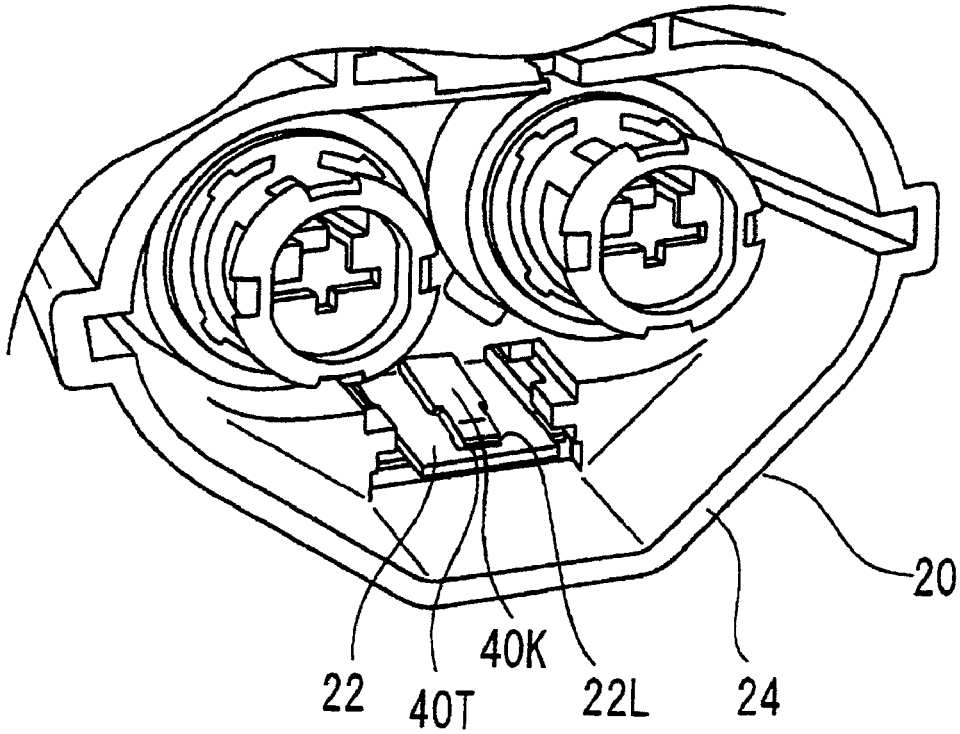
FIG. 6 are perspective views explanatory of retracting and advancing operations of an elongated cantilever member 40K, and FIG. 6(*a*) shows a retracted condition, and FIG. 6(*b*) shows an advanced condition.
Figure 6:
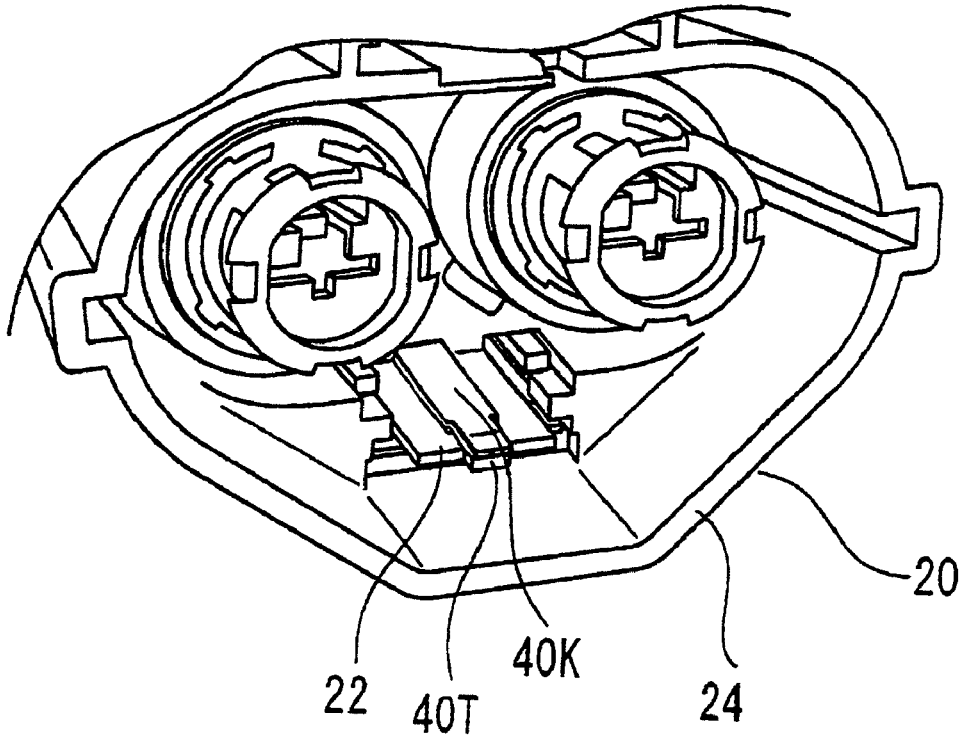

FIGS. 6(*a*) and 6(*b*) are perspective views explanatory of retracting and advancing operations of the elongated cantilever member 40K, and FIG. 6(*a*) shows a retracted condition, and FIG. 6(*b*) shows an advanced condition.

In FIG. 6(*a*), the projection 40T at the distal end of the elongated cantilever member 40K is retained in the retaining hole 22L formed in the portion of the cantilever arm 22 (of the main female connector 20) disposed near to the distal end thereof, and therefore the elongated cantilever member 40K has the function of preventing the interlock female connector 30 from moving in the fitting direction.

In FIG. 6(*b*), the elongated cantilever member 40K advances to a foremost position in the fitting direction, and the projection 40T of the elongated cantilever member 40K slides over the distal end 22S of the cantilever arm 22 to be retainingly engaged with the distal end 22S, and thus the elongated cantilever member 40K has the function of assisting in the locking operation and the canceling operation.

(Operation of Elongated Cantilever Member 40K)

The elongated cantilever member 40K moves together with the block member 40B, and therefore when the elongated cantilever member 40K is moved to the foremost position in the fitting direction, the projection 40T of the elongated cantilever member 40K slides over the distal end 22S of the cantilever arm 22 of the main female connector 20 to be retainingly engaged with the distal end 22S, thus assisting in the locking and canceling operations.

For disengaging the projection 40T of the elongated cantilever member 40K from the distal end 22S of the cantilever arm 22, the annular portion 41 of the lock assistant 40 is pulled hard, and as a result the distal end portion of the elongated cantilever member 40K is lifted, so that the slanting surface of the projection 40T is disengaged from the distal end 22S of the cantilever arm 22, and therefore the lock assistant 40 can be moved.

The constructions and operations of the five elements (the main male connector 12, the main female connector 20, the interlock male connector 13, the interlock female connector 30 and the lock assistant 40) forming the complex connector of the invention have been described above.

Next, in the complex connector having the above constructions and functions, (1) how to prevent the erroneous fitting (in which the interlock connector (13 and 30) is fitted in the fitting operation of the complex connector prior to the fitting of the main connector (12 and 20)) and (2) how to prevent the erroneous disengagement (in which the main connector (12 and 20) is disengaged in the disengaging operation of the complex connector prior to the disengagement of the interlock connector (13 and 30) from each other) will be described with reference to FIGS. 7 to 13. FIGS. 7 to 13 are schematic views for the better understanding of the complex connector of the invention.

(Fitting Operation of Complex Connector)

First, the fitting operation of the complex connector of the invention, as well as the reason why the erroneous fitting in which the interlock connector is disengaged in the fitting operation of the complex connector prior to the fitting of the main connector will be described with reference to FIGS. 7 to 10.

(First, the Main Connector is Fitted.)

Figure 7:
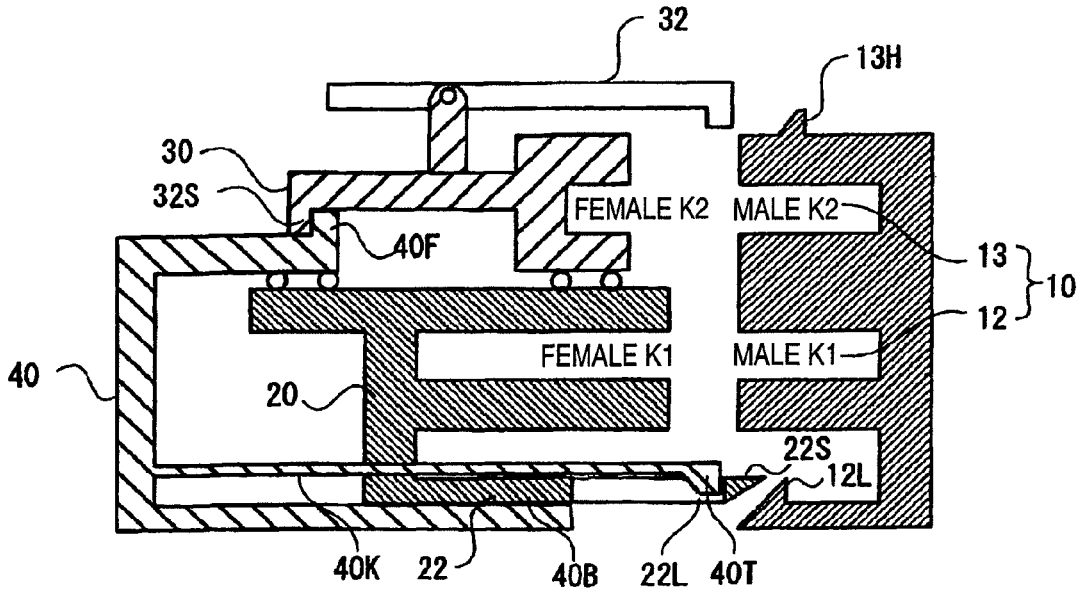
FIGS. 7 to 10 are schematic views explanatory of a first function for preventing a preferential fitting of the interlock connector.
Figure 7:
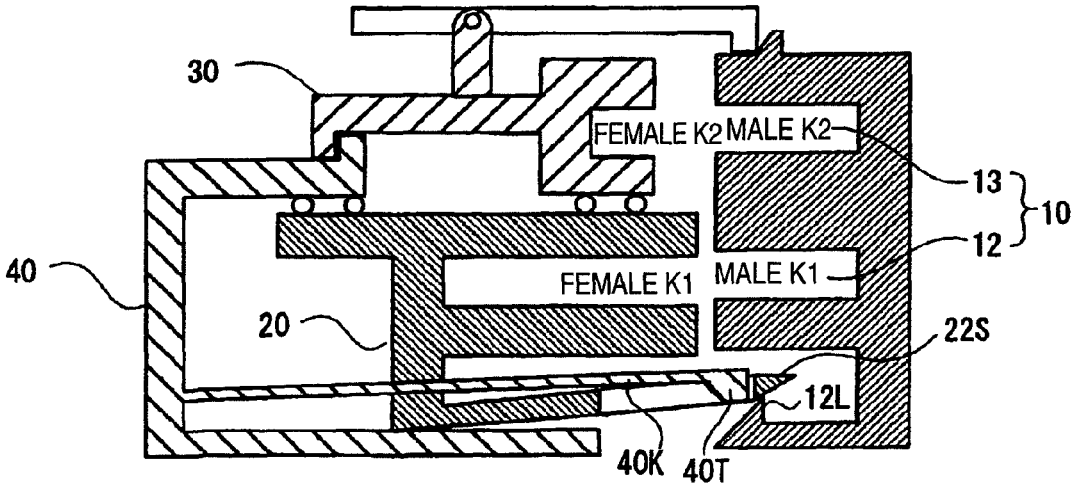

(1) (a) in FIG. 7 shows a condition before the fitting of the complex connector, that is, a condition in which the main connector, as well as the interlock connector, is disengaged.

In the drawings, the male connector 10 includes the main male connector 12 and the interlock male connector 13 which are formed integrally with each other, and the male terminals (not shown) of a K1 circuit are received in the housing of the main male terminal 12, while the male terminals (not shown) of a K2 circuit are received in the housing of the interlock male connector 13. The lock claw 13H is formed on the interlock male connector 13.

On the other hand, the interlock female connector 30 and the lock assistant 40 are mounted on the housing of the main female connector 20 (in which the female terminals of the K1 circuit are received) so as to move independently of each other. In the interlock female connector 30 having the female terminals (not shown) of the K2 circuit, the clothespin-like clip 32 (which is shown in FIGS. 7 to 10 as a hook 32L for engagement with the lock claw 13H) for engagement with the lock claw 13H of the interlock male connector 13 is provided at the upper portion of the housing, and the L-shaped stopper 30S having the downwardly-directed free (or distal) end portion is provided at the lower portion of the rear side of the housing.

The lock member 40F is provided at the upper portion of the lock assistant 40, and the elongated cantilever member 40K and the block member 40B are provided at the lower portion of the lock assistant 40. The projection 40T formed at the distal end of the elongated cantilever member 40K is received in the retaining hole 22L of the main female connector 20, and therefore the lock assistant 40 can not move in the fitting direction (the right-hand direction in FIG. 7) on the housing of the main female connector 20. Therefore, the lock member 40F of the lock assistant also can not move in the fitting direction, and the L-shaped stopper 30S (and hence the interlock female connector 30) abutting against the lock member 40F is prevented from movement in the fitting direction.

(2) (b) in FIG. 7 shows a condition immediately before the main male and female connectors are fitted together. Namely, (b) in FIG. 7 shows a condition in which although the lock claw 12L of the main male connector 12 contacts the distal end 22S of the cantilever arm 22 of the main female connector 20 to lift this distal end 22S, the main male connector 12 and the main female connector 20 are not yet fitted together.

In (b) in FIG. 7, the projection 40T of the elongated cantilever member 40K is stilled received in the retaining hole 22L of the main female connector 20, and therefore the interlock female connector 30 can not move in the fitting direction, and therefore the interlock female connector 30 is prevented from being fitted to the interlock male connector 13 before the main male connector 12 and the main female connector 20 are fitted together (Means for preventing the erroneous fitting).

Figure 8:
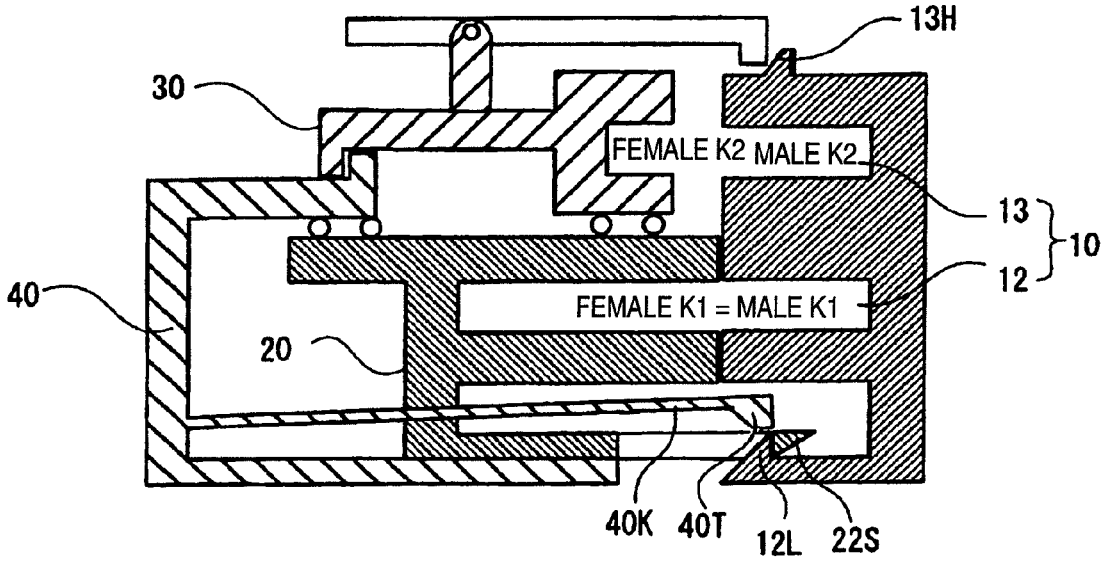
Figure 8:
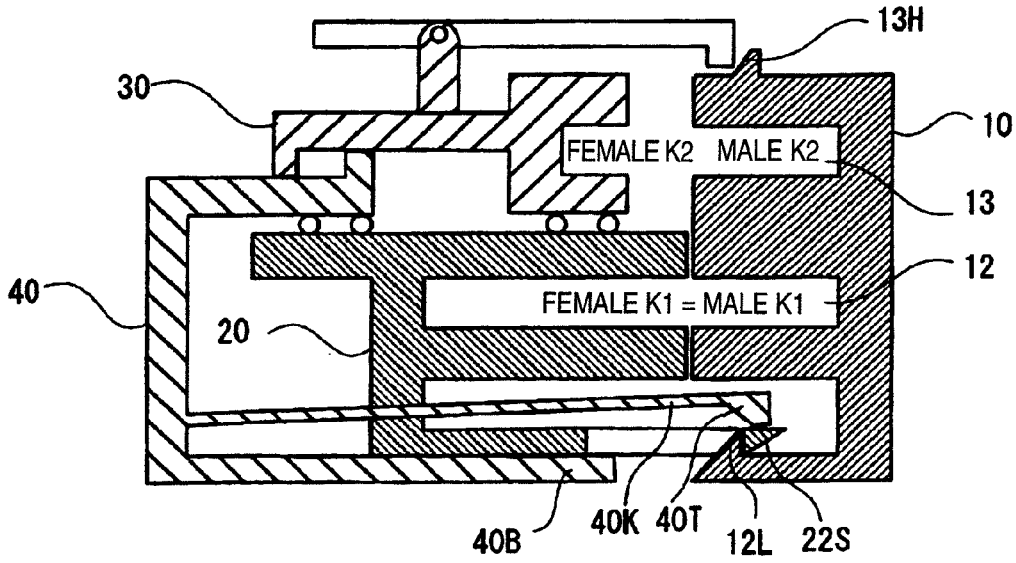

(3) (c) in FIG. 8 shows a condition in which the lock claw 12L of the main male connector 12 slides over the distal end 22S of the cantilever arm 22 of the main female connector 20 to be engaged with this distal end 22S, so that the main male connector 12 and the main female connector 20 are fitted together. As will be appreciated from (c) in FIG. 8, the lock claw 12L of the main male connector 12 is fitted into the retaining hole 22L of the main female connector 22 from the lower side thereof, and therefore the projection 401 of the elongated cantilever member 40K is forced out of the retaining hole 22L, and as a result the lock assistant 40 can move on the housing of the main female connector 20 in the fitting direction.

(4) (d) in FIG. 8 shows a condition in which the lock assistant 40 (and hence the elongated cantilever member 40K) which can move on the housing of the main female connector 20 after the fitting of the main male and female connectors 12 and 20 begins to slightly move in the fitting direction (the right-hand direction in (d) in FIG. 8).

Figure 9:
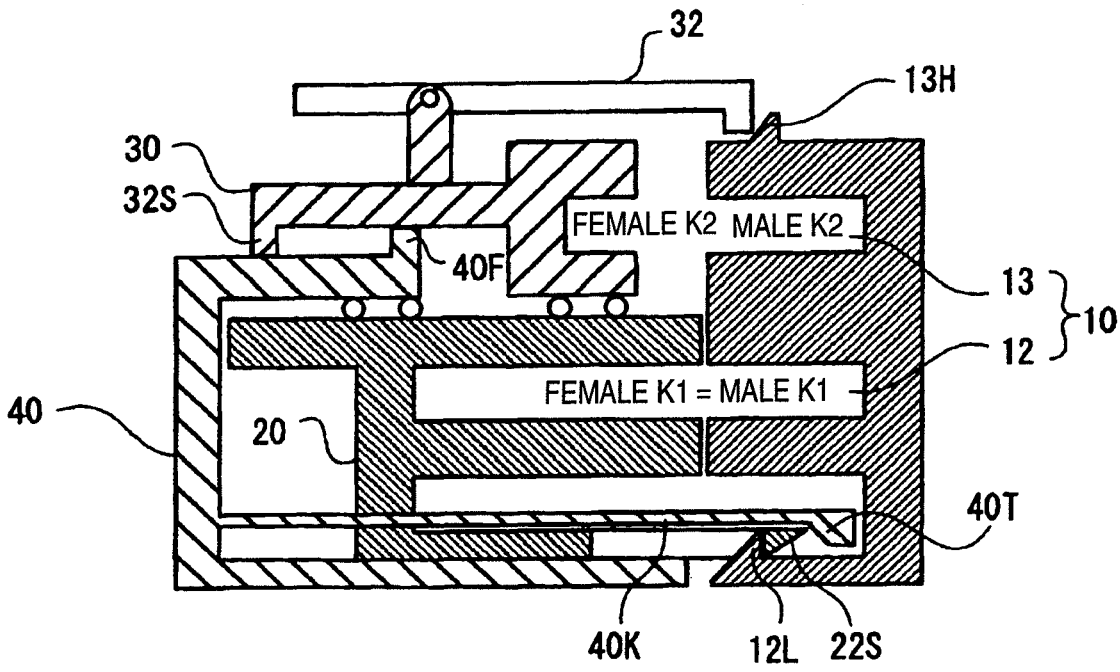
Figure 9:
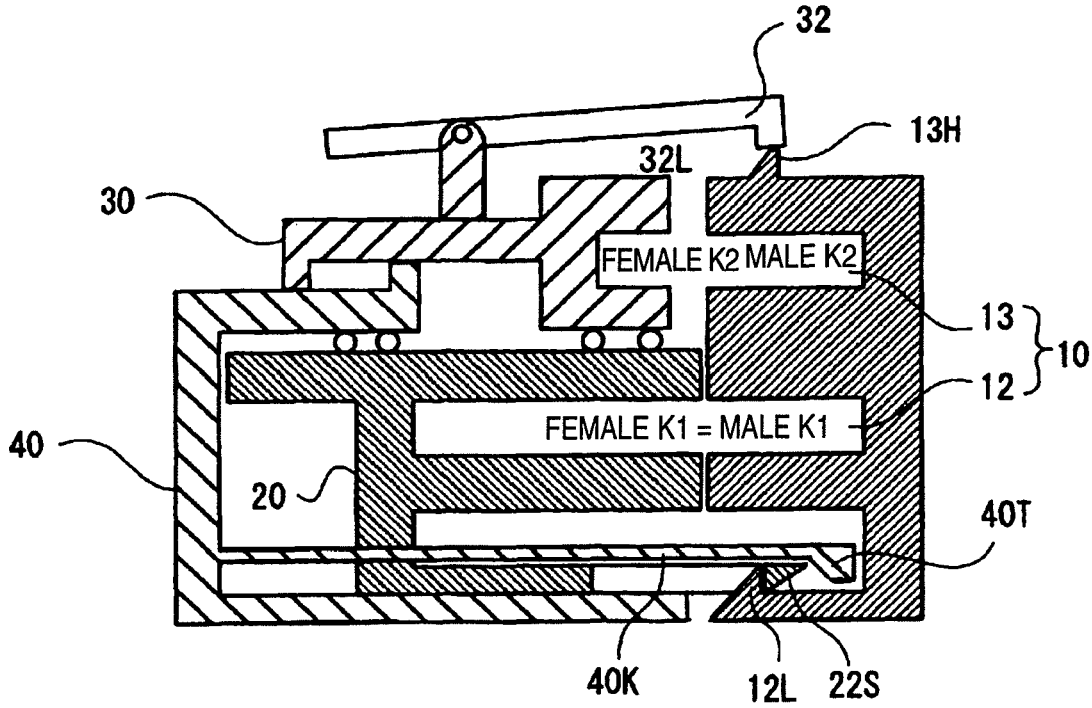

(5) (e) in FIG. 9 shows a condition in which the elongated cantilever member 40K is moved to the foremost position in the fitting direction, so that the projection 40T of the elongated cantilever member 40K passes past the distal end 22S of the cantilever arm 22 of the main male connector 12 and is retainingly engaged with this distal end 22S.

Therefore, the lock member 40F of the lock assistant 40 is also moved in the fitting direction, so that a large gap is formed between the lock member 40F and the L-shaped stopper 30S. In the condition of (c) in FIG. 8, there is no gap therebetween, and therefore the interlock female connector 30 can not move in the fitting direction. However, the interlock female connector 30 can now move in the fitting direction.

(6) (f) in FIG. 9 shows a condition in which the interlock female connector 30 which now can move in the fitting direction begins to slightly move on the housing of the main female connector 20 in the fitting direction, and the hook 32L at the distal end abuts against the lock claw 13H and is about to slide over this lock claw 13H (but the interlock female connector 30 is not yet fitted to the interlock male connector 13). The main female connector 20 and the main male connector 12 have already been fitted together in (c) in FIG. 8.

Figure 10:
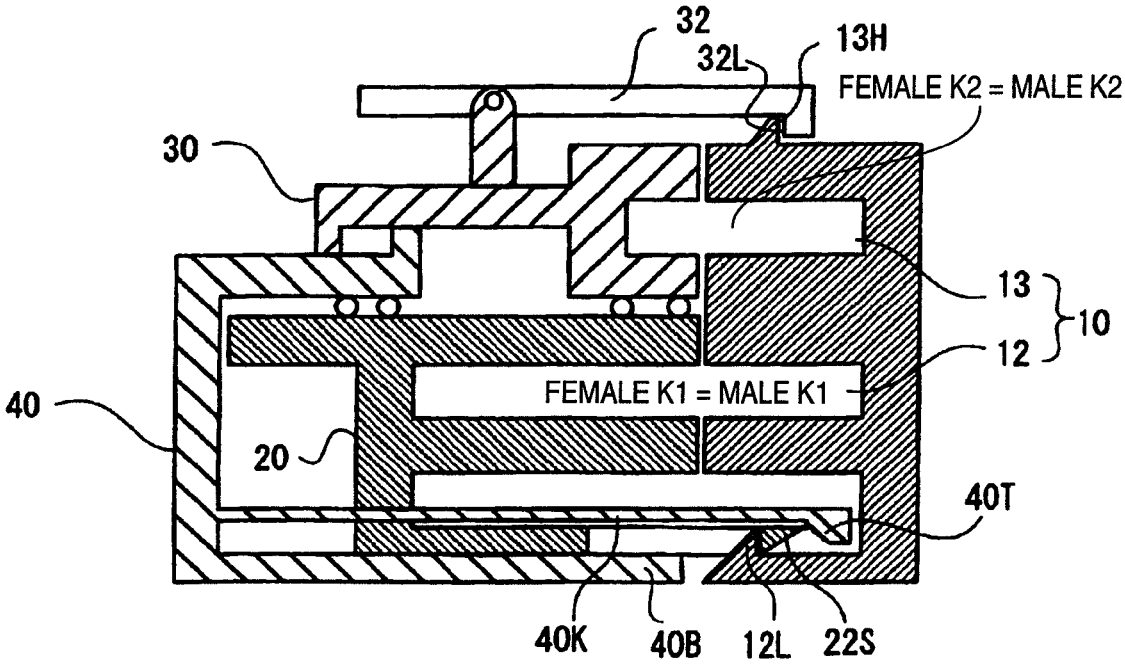

(7) (g) in FIG. 10 shows a condition in which the hook 32L at the distal end of the interlock female connector 30 slides over the lock claw 13H, so that the interlock female connector 30 is fitted to the interlock male connector 13. Here, at last the fitting of the interlock male and female connectors 13 and 30 (that is, the connection of the K2 circuit) is completed.

As described above, the complex connector of the invention has the function of preventing the erroneous fitting in which the interlock connector (13 and 30) is fitted prior to the fitting of the main connector (12 and 20).

(Disengaging Operation of Complex Connector)

Next, the disengaging operation of the complex connector will be described with reference to FIGS. 11 to 13.

Namely, the reason why the erroneous disengagement in which the main connector (12 and 20) is disengaged in the disengaging operation of the complex connector prior to the disengagement of the interlock connector (13 and 30) can be prevented will be described.

(First, the Interlock Connector is Disengaged)

Figure 11:
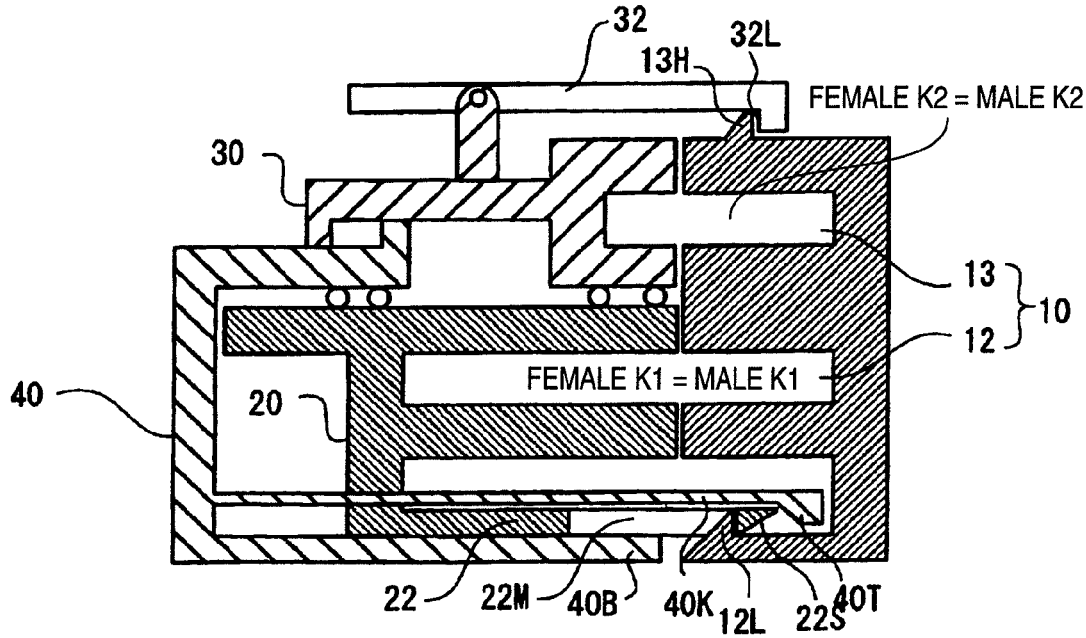
FIGS. 11 to 13 are schematic views explanatory of a second function for preventing a preferential disengagement of the main connector.
Figure 11:
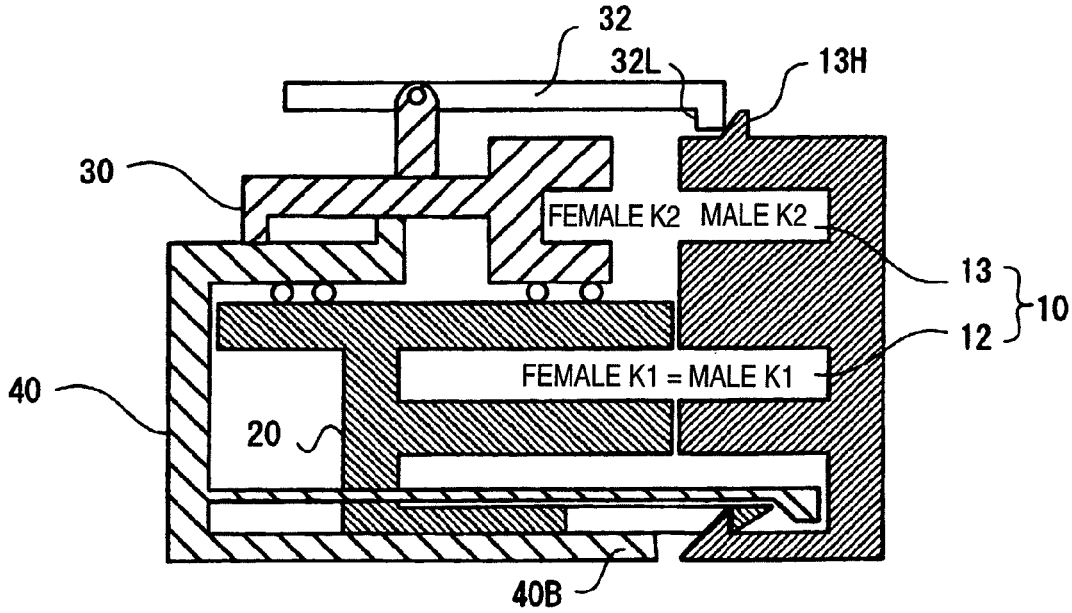

(1) (a) in FIG. 11 shows the fitted condition of the complex connector of the invention, that is, the condition in which the main connector (the K1 circuit) as well as the interlock connector (the K2 circuit) is fitted. Here, even if trying to first disengaging the main connector (the K1 circuit) in the fitted condition of the interlock connector (the K2 circuit), the main connector can not be disengaged because of the double lock function, that is, since (a) the lock claw 13H of the interlock male connector 13 and the retaining portion 32L of the interlock female connector 30 are retainingly engaged with each other, and (b) the distal end 22S of the cantilever arm 22 of the main female connector 20 is retainingly engaged with the lock claw 12L.

Therefore, for disengaging the distal end 22S of the cantilever arm 22 of the main female connector 20 from the lock claw 12L, it is necessary to press the intermediate portion 22M (see also FIG. 5) of the cantilever arm 22 inwardly. However, the intermediate portion 22M can be pressed since the block member 40B of the lock assistant 40 covers the intermediate portion 22M as shown in FIG. 11A. For moving the block member 40B rearward so as to expose the intermediate portion 22M, the lock assistant 40 is pulled hard, and as a result the projection 40T of the elongated cantilever member 40K is disengaged from the distal end 22S of the cantilever arm 22, so that the lock assistant 40 (and hence the block member 40B) can be moved rearward.

Therefore, first, the retaining engagement of the engagement portion 32 of the interlock female connector 30 with the lock claw 13H of the interlock male connector 13 is canceled, and then the interlock female connector 30 is pulled from the interlock male connector 13, and as a result the interlock connector (the K2 circuit) in the complex connector is disengaged as shown in (b) in FIG. 11.

Thus, in the present invention, it is impossible to first disengage the main connector (the K1 circuit) in the fitted condition of the interlock connector (the K2 circuit), and it is necessary to first disengage the interlock connector (the K2 circuit) (Means for preventing the erroneous disengagement).

Therefore, in the case where the main connector of the present invention is used in a main circuit (K1) to which a motor and an inverter are connected, and the interlock connector of the present invention is used in a control circuit (K2) for this motor, a signal of the motor control circuit is first interrupted, and therefore the motor is not driven thereafter, and the motor is stopped after it rotates for a short while by inertia. A procedure of a time lag operation is so determined that the main male connector 12 and the main female connector 20 in the main circuit (K1) are disengaged from each other at the time when the motor is stopped, and with this arrangement even when the operator inadvertently touches the connector terminal to which the inverter is connected, he will not get an electric shock (since the motor is already stopped, and the generation of electricity is not effected.)

(Then, the Main Connector is Disengaged).

Figure 12:
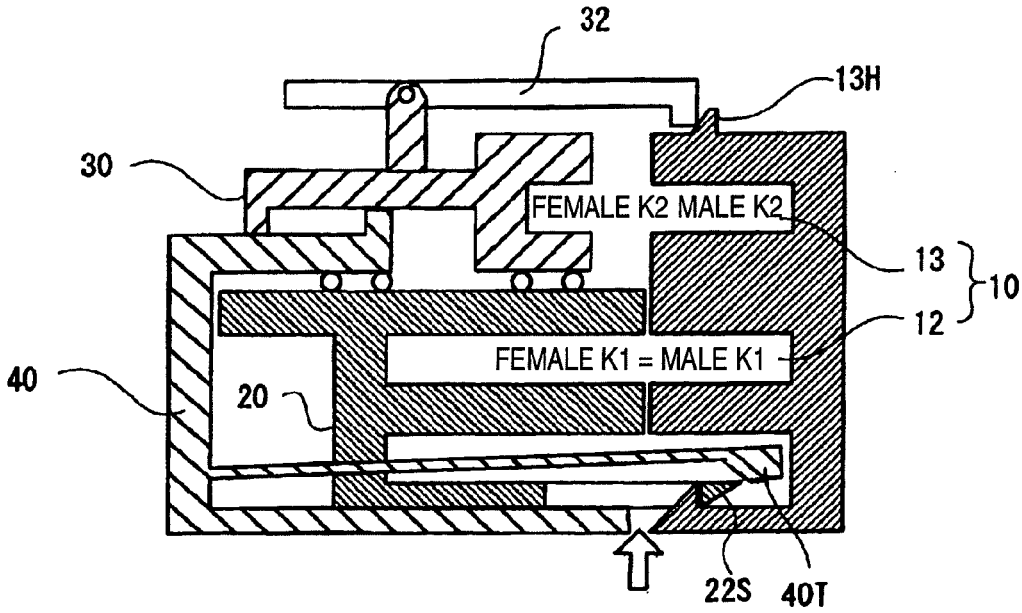
Figure 12:
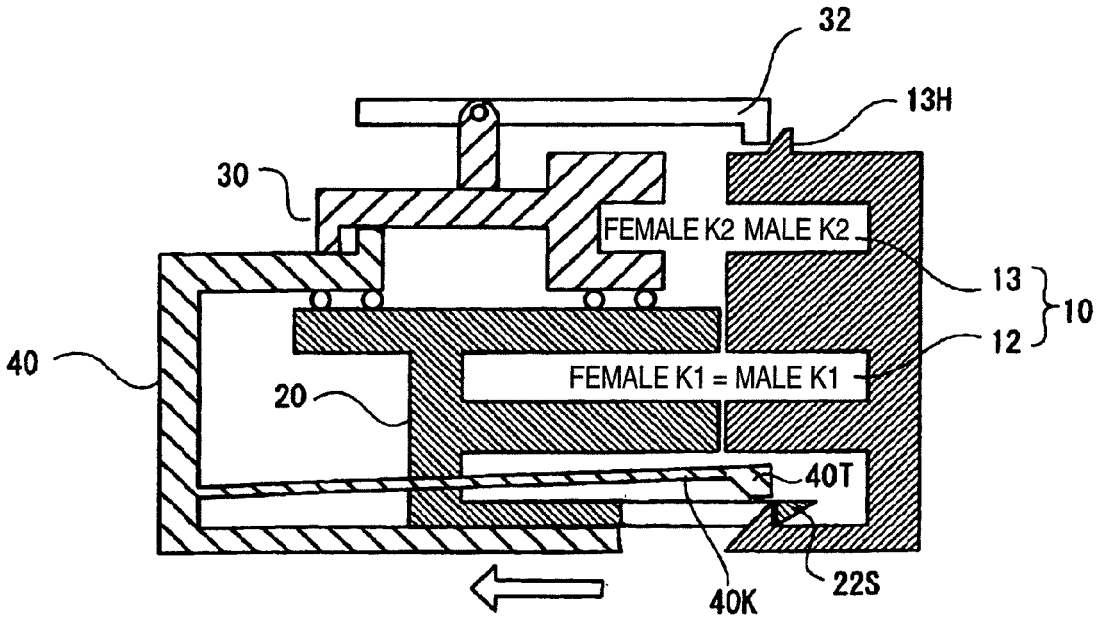

(3) For disengaging the main female connector 20 and the male connector 10 (which are fitted together) from each other, first, the lock assistant 40 is pulled hard rearward as shown in (c) in FIG. 12, and as a result the slanting surface of the projection 40T of the elongated cantilever member 40K is disengaged from the distal end 22S of the cantilever arm 22, and therefore the lock assistant 40 can be moved rearward as shown in (d) in FIG. 12. As a result, the block member 40B formed integrally with the lock assistant 40 is also moved rearward, and therefore the intermediate portion 22M of the cantilever arm 22 is exposed.

Figure 13:
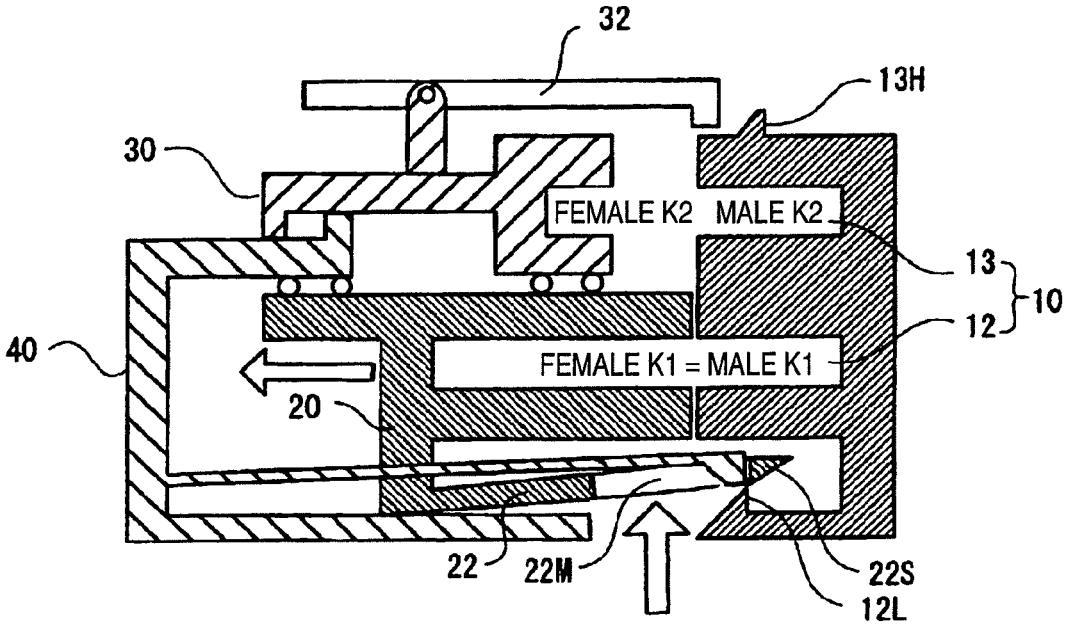
Figure 13:
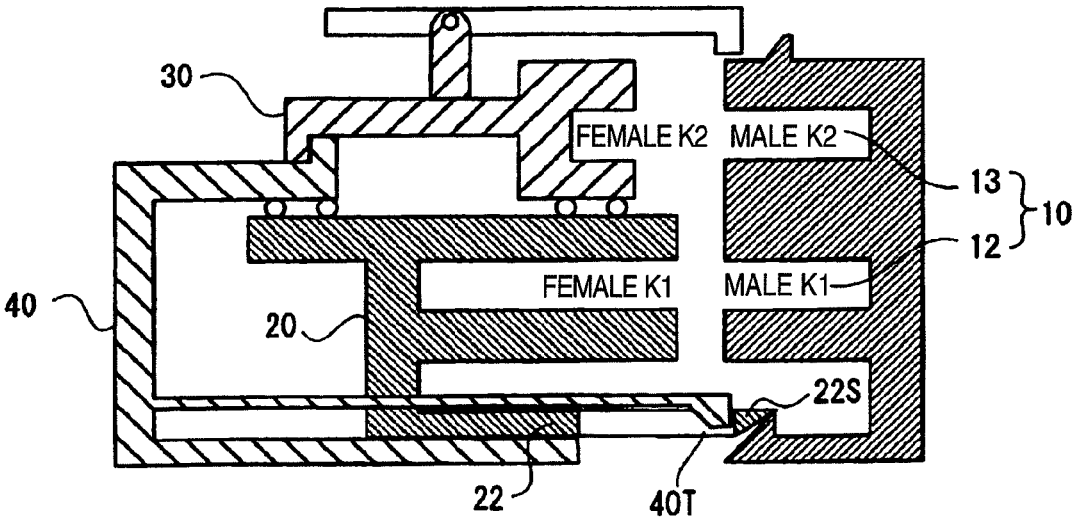

(4) Then, when the intermediate portion 22M is pressed inwardly, the retaining engagement of the cantilever arm 22 of the main female connector 20 with the lock claw 12L of the main male connector 12 is canceled ((e) in FIG. 13).

(5) When the main female connector 20 is pulled rearward while maintaining this condition, the main female connector 20 is disengaged from the male connector 10, so that the K1 circuit is opened. And, when the finger is disengaged from the cantilever arm 22, the cantilever arm 22 is restored into its original condition because of its elasticity, thus completing the disengagement of the main connector ((f) in FIG. 13).

Thus, the complex connector of the invention has the function of preventing the erroneous disengagement in which the main connector (12 and 20) is disengaged in the disengaging operation prior to the disengagement of the interlock connector (13 and 30).

The operation of the complex connector has been described above, using the schematic views for the better understanding of the invention, and the operations around the cantilever arm 22 which have not been described by the schematic views will be described supplementally with reference to FIGS. 14 to 17 which are vertical cross-sectional views of the complex connector.

(Fitting Operation)

FIG. 14 is a vertical cross-sectional view showing a condition in which the main female connector 20 having the interlock female connector 30 and the lock assistant 40 movably mounted thereon is located close to the male connector 10 having the main male connector 12 and the interlock male connector 13 which are formed integrally with each other. FIG. 14 corresponds to (a) in FIG. 7.

In FIG. 14, the lock claw 12L is formed at the lower portion of the housing 15 of the main male connector 12. When this lock claw 12L is fitted in the retaining hole 22L formed through the portion of the cantilever arm 22 (formed at the lower portion of the housing of the main female connector 20) disposed near to the distal end thereof, the fitting operation is completed.

The downwardly-directed L-shaped stopper 30S is formed at the distal end of the cantilever arm 30L formed on and extending from the lower portion of the rear end (facing in the disengaging direction) of the interlock female connector 30. This L-shaped stopper 30S abuts against the lock member 40F formed at the upper portion of the lock assistant 40 facing in the fitting direction (direction X). In this condition, the projection 40T at the distal end of the elongated cantilever member 40K formed at the lower portion of the lock assistant 40 is retained in the retaining hole 22L formed through the portion of the cantilever arm 22 disposed near to the distal end thereof, and therefore the movement of the interlock female connector 30 in the fitting direction is prevented.

Figure 15:
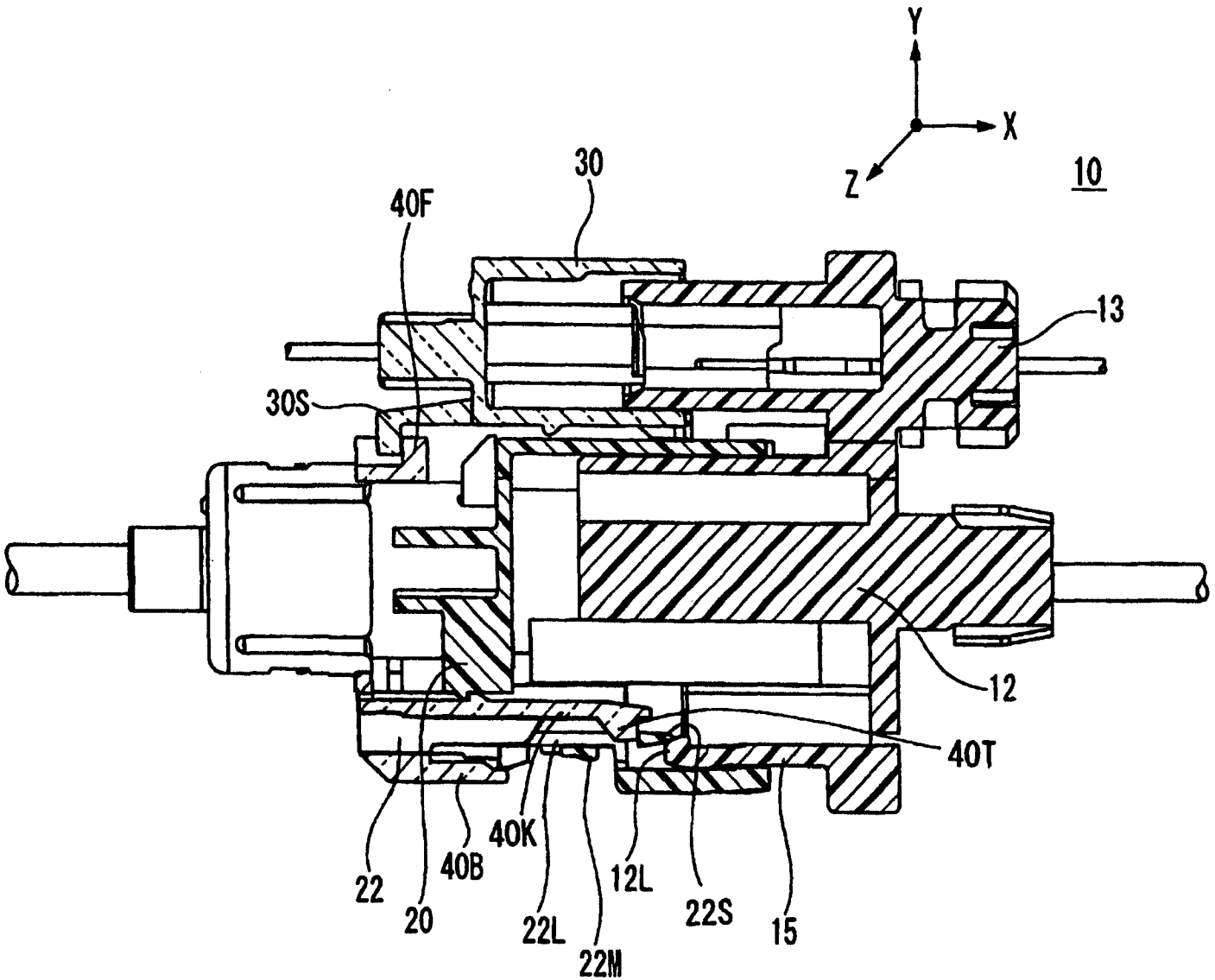
FIG. 15 is a vertical cross-sectional view through the axis, showing a condition in which the main female connector and the main male connector contact each other, but are not fitted together.

FIG. 15 shows a condition in which the lock claw 12L of the main male connector 12 abuts against the distal end of the cantilever arm 22 of the main female connector 20.

In this condition, even if trying to fit the interlock female connector 30 to the interlock male connector 13, the interlock female connector 30 can not be moved since the lock member 40F prevents the movement of the L-shaped stopper 30S of the interlock female connector 30. Therefore, this prevents the occurrence of the situation in which in the condition in which the main male connector 12 and the main female connector 20 are not yet fitted together, only the interlock female connector 30 is first fitted to the interlock male connector 13.

Figure 16:
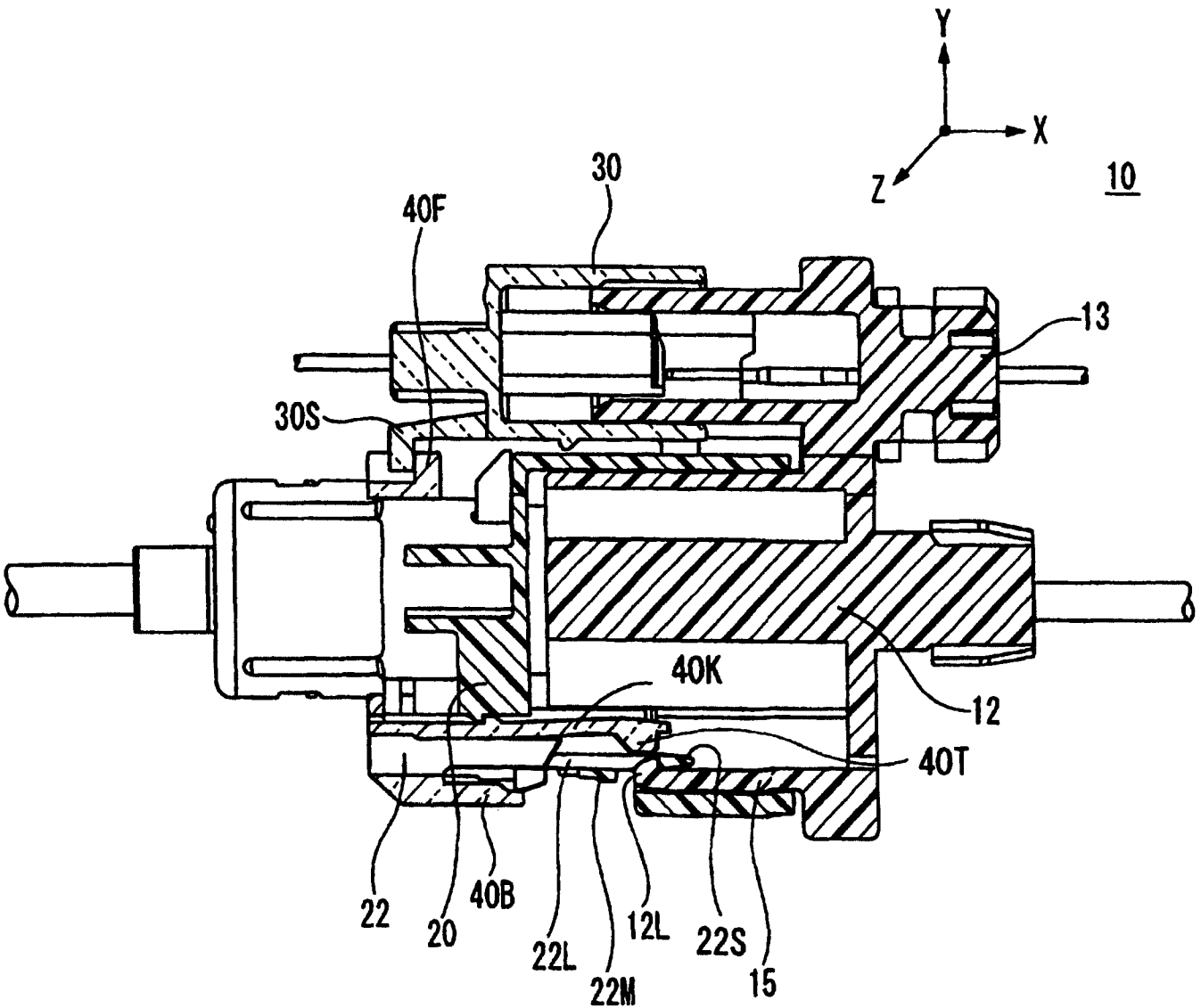
FIG. 16 is a vertical cross-sectional view through the axis, showing a condition in which the main connector is fitted, and the interlock connector is not fitted, and the block member is located in its retracted position.

When the main male connector 12 and the main female connector 20 are fitted together as shown in FIG. 16, the lock claw 12L of the main male connector 12 is fitted into the retaining hole 22L from the lower side thereof, and therefore the projection 401 of the elongated cantilever member 40K is forced out of the retaining hole 22L, so that the lock assistant 40 can move on the housing of the main female connector 20 in the fitting direction. FIG. 16 corresponds to (d) in FIG. 8.

Figure 17:
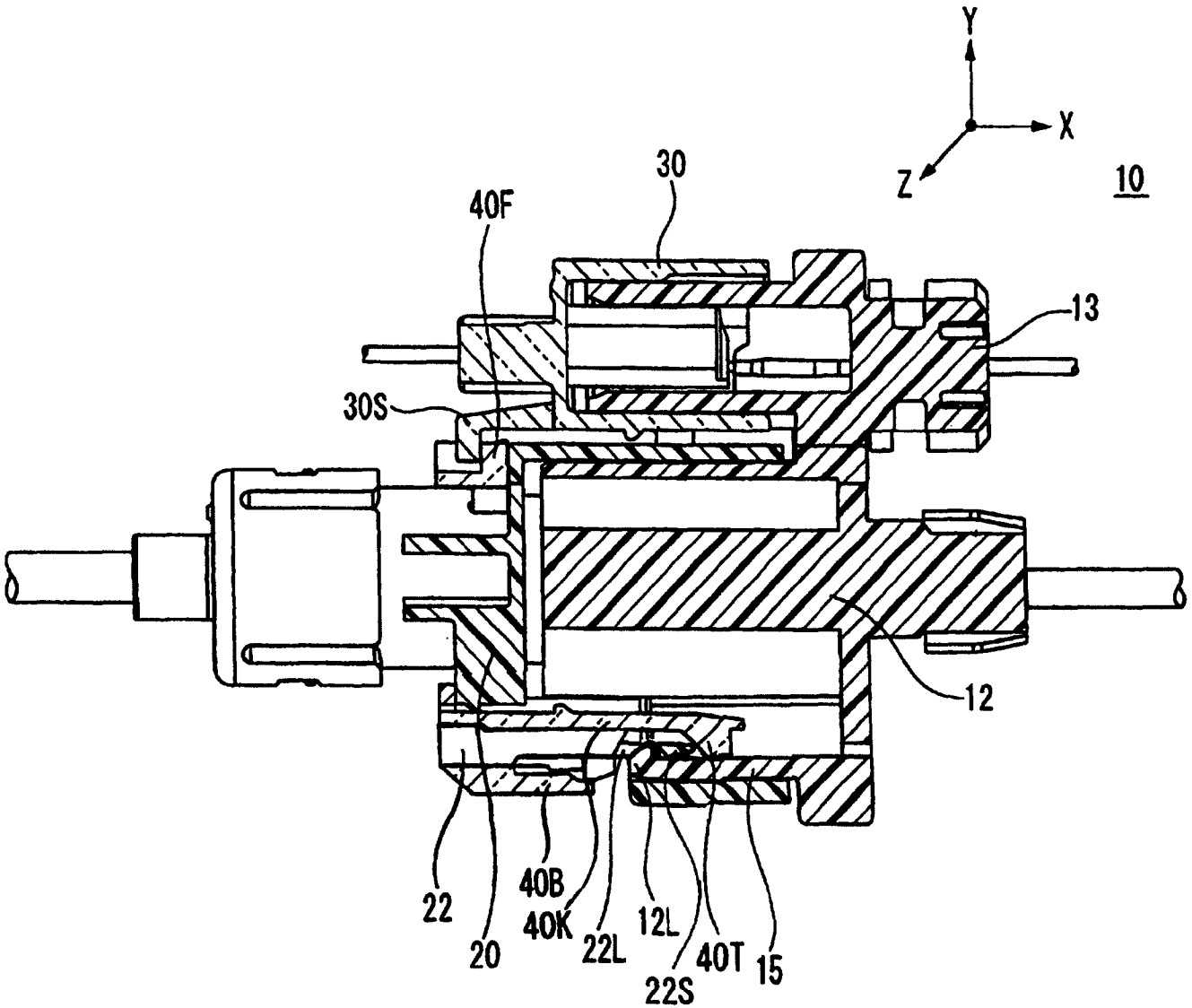
FIG. 17 is a vertical cross-sectional view through the axis, showing a condition in which both the main connector and the interlock connector are fitted.

FIG. 17 shows a condition in which the lock assistant 40 moves on the housing of the main female connector 20 in the fitting direction, and also the interlock male connector 13 and the interlock female connector 30 are fitted together. At this time, the projection 40T at the distal end of the elongated cantilever member 40K slides over the distal end 22S of the cantilever arm 22, and is retainingly engaged with this distal end 22S. FIG. 17 corresponds to (g) in FIG. 10.

As described above, in the present invention, the erroneous fitting in which the interlock connector (13 and 30) is fitted in the fitting operation of the complex connector prior to the fitting of the main connector (12 and 20) can be prevented.

(Disengaging Operation)

In the fitted condition of FIG. 17, the lock assistant 40 can not be moved rearward in the disengaging direction (the left-hand direction in FIG. 17) because of the double lock function, and therefore the main male connector 12 and the main female connector 20 can be disengaged from each other prior to the disengagement of the interlock male connector 13 and the interlock female connector 30 from each other.

With respect to the first lock function, the interlock male connector 13 and the interlock female connector 30 are fitted together, and therefore the movement of the lock member 40F of the lock assistant 40 is prevented by the L-shaped stopper 30S formed at the lower portion of the rear end of the interlock female connector 30. With respect to the second lock function, the projection 40T (formed at the distal end of the elongated cantilever member 40K) which has slid over the distal end 22S of the cantilever arm 22 is retainingly engaged with this distal end 22S, and therefore the lock assistant 40 can not be moved rearward in the disengaging direction.

Since the lock assistant 40 can not be moved in the disengaging direction, the block member 40B formed at the lower potion of the lock assistant 40 continues to cover the intermediate portion 22M (FIG. 16) of the cantilever arm 22, and in this condition the intermediate portion 22M can be pressed inwardly because of the block member 40B, and therefore the lock claw 12L of the main male connector 12 can not be disengaged from the retaining hole 22L of the main female connector 20, and the main male connector 12 and the main female connector 20 can be disengaged from each other.

Therefore, for disengaging the main male connector 12 and the main female connector 20 from each other, the double lock function must be canceled.

Figure 18:
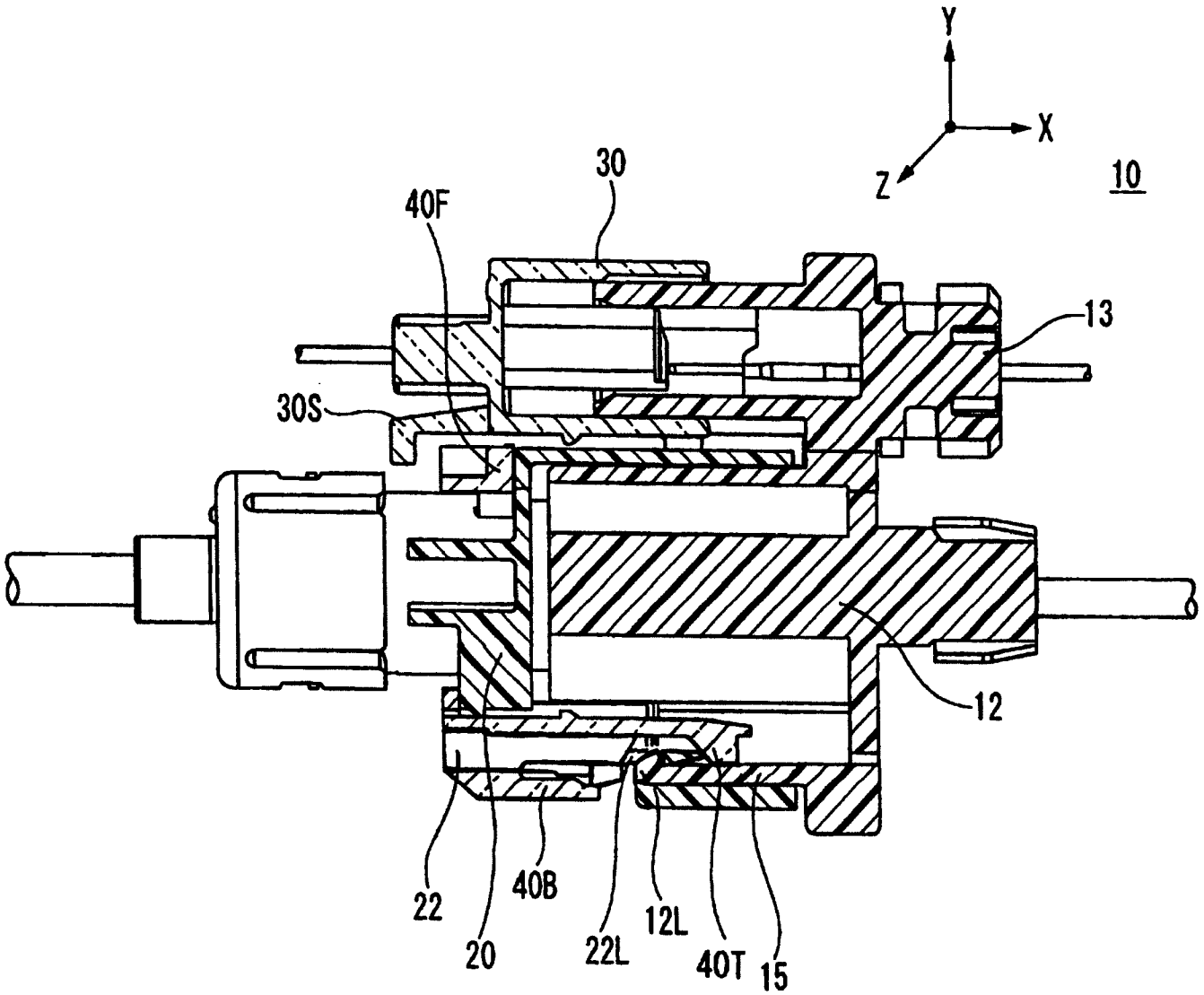
FIG. 18 is a vertical cross-sectional view through the axis, showing a condition in which only the interlock connector is disengaged, and the main connector is fitted.

For canceling the first lock function, the interlock female connector 30 is disengaged from the interlock male connector 13 as shown in FIG. 18, and is moved rearward (in the left-hand direction in FIG. 18). By doing so, the erroneous disengagement (that is, the preferential disengagement of the main connector) is prevented.

Figure 19:
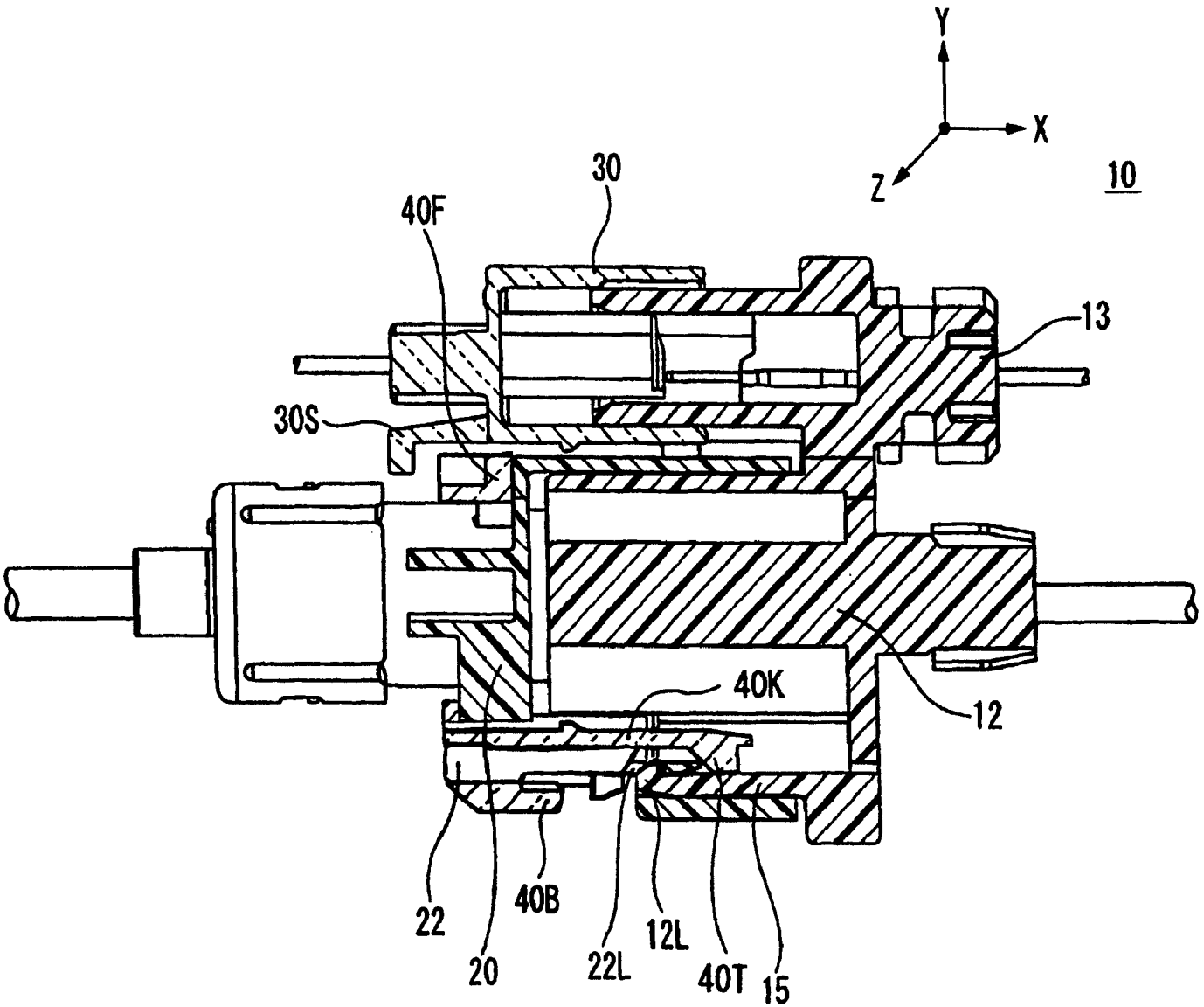
FIG. 19 is a partly-broken, vertical cross-sectional view explanatory of a pressing piece portion of a lock assistant.

For canceling the second lock function, the lock assistant 40 is pulled hard rearward as shown in FIG. 19. As a result, the rear slanting surface of the projection 40T of the elongated cantilever member 40K slides over the distal end 22S of the cantilever arm 22, and the projection 40T is disengaged from this distal end 22S, and the block member 40B of the lock assistant 40 is moved rearward (in the left-hand direction in FIG. 19).

The condition in which the block member 40B of the lock assistant 40 is moved rearward is shown in FIG. 16. Therefore, when the block member 40B is moved from the intermediate portion 22M, the operator can press the intermediate portion 22M, and therefore the main male connector 12 and the main female connector can be disengaged from each other.

Thus, in the present invention, the erroneous disengagement in which the main connector (12 and 20) is disengaged in the disengaging operation of the complex connector prior to the interlock connector (13 and 30) can be prevented.

As described above, a time difference (time lag) is provided between the fitting/disengagement of the main male and female connectors 10 and 20 and the fitting/disengagement of the interlock male and female connectors 13 and 30, and by doing so, a rotating machine such as a motor is stopped by breaking the interlock signal circuit K2, and then the main circuit K1 is broken with a predetermined time lag. Therefore, at the time when the main circuit K1 is broken, the rotating machine such as a motor has been completely stopped, and therefore the risk of an electric shock due to an inverter or other device connected to the connector of the K1 circuit can be eliminated.

What is claimed is:

1. A complex connector, comprising:

a first connector including a first male connector and a first female connector to be fitted to and disengaged from the first male connector; and a second connector, including a second male connector and a second female connector to be fitted to and disengaged from the second male connector;

wherein the first male connector and the second male connector are formed integrally with each other;

wherein the second female connector is mounted on the first female connector so as to move in a fitting/disengaging direction;

wherein a lock assistant is mounted on the first female connector so as to move in the fitting/disengaging direction; and wherein the first male connector includes a retaining portion retaining engagement with the first female connector, and the first female connector includes a cantilever member extending toward the first male connector, and an engagement portion retaining engagement with the retaining portion of the first male connector is formed at a portion of disposed near to a distal end of the cantilever member, and in a condition in which the first male connector and the first female connector are fitted together, the retaining portion of the first male connector is retainingly engaged with the engagement portion; and the second female connector includes a projecting portion, and the lock assistant includes an abutment portion for abutting against the projecting portion, and when the projecting portion of the second female connector abuts against the abutment portion, the second female connector can not move any further on the first female connector in the fitting direction; and the lock assistant includes an elongated cantilever member extending toward the first male connector, and a projection for retaining engagement with the engagement portion of the first female connector is formed at a distal end of the elongated cantilever member, and in a condition in which the first male connector and the first female connector are disengaged from each other, the projection is retainingly engaged with the engagement portion, and in a condition in which the projection is retainingly engaged with the engagement portion, the projecting portion of the second female connector abuts against the abutment portion of the lock assistant.

2. The complex connector according to claim 1, wherein the arrangement of the first connector and the second connector can be changed in a reverse manner, and also the arrangement of the male and female connectors of each of the first and second connectors can be changed in a reverse manner.

3. A complex connector, comprising:

a first connector including a first male connector and a first female connector to be fitted to and disengaged from the first male connector; and a second connector including a second male connector and a second female connector to be fitted to and disengaged from the second male connector; and wherein the first male connector and the second male connector are formed integrally with each other; and the second female connector is mounted on the first female connector so as to move in a fitting/disengaging direction;

a lock assistant is mounted on the first female connector so as to move in the fitting/disengaging direction; and the first male connector includes a retaining portion for retaining engagement with the first female connector, and the first female connector includes a cantilever member extending toward the first male connector, and an engagement portion for retaining engagement with the retaining portion of the first male connector is formed at a portion disposed near to a distal end of the cantilever, and in a condition in which the first male connector and the first female connector are fitted together, the retaining portion of the first male connector is retainingly engaged with the engagement portion; and when an intermediate portion of the cantilever member of the first female connector is pressed inwardly from an outer side of the first female connector, the engagement portion is withdrawn from the retaining portion of the first male connector, so that the first male connector and the first female connector can be disengaged from each other; and the lock assistant includes an elongated cantilever member extending toward the first male connector, and a projection for retaining engagement with a distal end of the cantilever member of the first female connector is formed at a distal end of the elongated cantilever member, and in the condition in which the first male connector and the first female connector are fitted together, the projection is retainingly engaged with the distal end of the cantilever member; and the lock assistant includes a block member extending toward the first male connector, and when the projection is retainingly engaged with the distal end of the cantilever member in the fitted condition of the first male and female connectors, the block member covers an outer side of the intermediate portion of the cantilever member of the first female connector.

4. The complex connector according to claim 3, wherein the arrangement of the first connector and the second connector can be changed in a reverse manner, and also the arrangement of the male and female connectors of each of the first and second connectors can be changed in a reverse manner.

5. A complex connector, comprising:

a first connector including a first male connector and a first female connector for being fitted to and disengaged from the first male connector;

a second connector, including a second male connector and a second female connector for being fitted to and disengaged from the second male connector; and wherein the first male connector and the second male connector are formed integrally with each other; and wherein the second female connector is mounted on the first female connector so as to move in a fitting/disengaging direction;

wherein a lock assistant is mounted on the first female connector so as to move in the fitting/disengaging direction; and wherein the first male connector includes a retaining portion retaining engagement with the first female connector, and the first female connector includes a cantilever member extending toward the first male connector, and an engagement portion retaining engagement with the retaining portion of the first male connector is formed at a portion of disposed near to a distal end of the cantilever member, and in a condition in which the first male connector and the first female connector are fitted together, the retaining portion of the first male connector is retainingly engaged with the engagement portion; and when an intermediate portion of the cantilever member of the first female connector is pressed inwardly from an outer side thereof, the engagement portion is withdrawn from the retaining portion of the first male connector, so that the first male connector and the first female connector can be disengaged from each other; and the second female connector includes a projecting portion, and the lock assistant includes an abutment portion for abutting against the projecting portion, and when the projecting portion of the second female connector abuts against the abutment portion, the second female connector can not move any further on the first female connector in the fitting direction; and the lock assistant includes an elongated cantilever member extending toward the first male connector, and a projection for retaining engagement with the engagement portion of the cantilever member of the first female connector and also for retaining engagement with a distal end of the cantilever member is formed at a distal end of the elongated cantilever member, and (a) in a condition in which the first male connector and the first female connector are disengaged from each other, the projection is retainingly engaged with the engagement portion, and in this condition the projecting portion of the second female connector abuts against the abutment portion of the lock assistant; and (b) the lock assistant includes a block member extending toward the first male connector, and when the projection is retainingly engaged with the distal end of the cantilever member in the fitted condition of the first male and female connectors, the block member covers an outer side of the intermediate portion of the cantilever member of the first female connector.

6. The complex connector according to claim 5, wherein the lock assistant includes an annular body portion for surrounding an outer periphery of a housing of the first female connector, and the abutment portion formed at that portion of the annular body portion facing the second female connector; and the elongated cantilever member and the block member are formed at that portion of the annular body portion corresponding to the cantilever member of the first female connector, and are so arranged that the cantilever member is disposed between the elongated cantilever member and the block member such that the elongated cantilever member is disposed at an inner side of the cantilever member while the block member is disposed at an outer side of the cantilever member.

7. The complex connector according to claim 6, wherein engagement members for engagement with each other are provided respectively at the second male connector and the second female connector, and in a condition in which the second male connector and the second female connector are fitted together, the engagement members are engaged with each other, and the fitted condition of the second male and female connectors can not be canceled unless the engagement of the engagement members with each other is canceled.

8. The complex connector according to claim 7, wherein one of the engagement members has a tapering surface, and at the time when the second male connector and the second female connector are fitted together, the engagement members are automatically engaged with each other.

9. The complex connector according to claim 5, wherein the arrangement of the first connector and the second connector can be changed in a reverse manner, and also the arrangement of the male and female connectors of each of the first and second connectors can be changed in a reverse manner.

* * * * *